US011415343B2

(12) United States Patent
Song et al.

(10) Patent No.: US 11,415,343 B2
(45) Date of Patent: Aug. 16, 2022

(54) AIR CONDITIONING APPARATUS AND CONTROL METHOD THEREOF

(71) Applicant: LG Electronics Inc., Seoul (KR)

(72) Inventors: Chiwoo Song, Seoul (KR); Yongcheol Sa, Seoul (KR); Youngjoo Shin, Seoul (KR); Ilyoong Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 158 days.

(21) Appl. No.: 16/775,912

(22) Filed: Jan. 29, 2020

(65) Prior Publication Data

US 2020/0370794 A1 Nov. 26, 2020

(30) Foreign Application Priority Data

May 23, 2019 (KR) ..... 10-2019-0060850

(51) Int. Cl.
*F25B 5/02* (2006.01)
*F25B 13/00* (2006.01)
*F25B 41/20* (2021.01)

(52) U.S. Cl.
CPC ..... *F25B 5/02* (2013.01); *F25B 13/00* (2013.01); *F25B 41/20* (2021.01); *F25B 2313/003* (2013.01); *F25B 2313/029* (2013.01); *F25B 2313/0233* (2013.01)

(58) Field of Classification Search
CPC ..... F25B 2313/0312; F25B 2313/0314; F25B 2500/18; F25B 2600/2515
See application file for complete search history.

(56) References Cited

U.S. PATENT DOCUMENTS

2005/0155361 A1 7/2005 Jung et al.
2006/0218948 A1* 10/2006 Otake ..... F25B 9/008 62/160
2012/0006050 A1 1/2012 Takayama et al.
2012/0118005 A1* 5/2012 Yamashita ..... F25B 25/005 62/513
2012/0266616 A1* 10/2012 Lee ..... F25B 47/02 62/80

(Continued)

FOREIGN PATENT DOCUMENTS

EP 2927614 10/2015
EP 2672201 3/2019

(Continued)

OTHER PUBLICATIONS

PCT International Search Report in International Appln. No. PCT/KR2020/003039, dated Jun. 11, 2020, 3 pages.

(Continued)

*Primary Examiner* — Henry T Crenshaw
(74) *Attorney, Agent, or Firm* — Fish & Richardson P.C.

(57) ABSTRACT

An air conditioning apparatus includes an outdoor device that is configured to circulate refrigerant and that includes a compressor and an outdoor heat exchanger, a plurality of indoor devices configured to circulate water, and a heat exchange device that connects the outdoor device with the indoor device. The heat exchange device includes a heat exchanger configured to exchange heat between the refrigerant and the water, and a switch device configured to control flow of refrigerant between the indoor device and the heat exchanger.

18 Claims, 13 Drawing Sheets

(56) References Cited

U.S. PATENT DOCUMENTS

| | | | | |
|---|---|---|---|---|
| 2014/0260387 | A1* | 9/2014 | Takenaka | F24F 11/72 62/205 |
| 2016/0238273 | A1* | 8/2016 | Takenaka | F25B 49/02 |
| 2016/0245570 | A1* | 8/2016 | Han | F25B 49/02 |
| 2016/0370045 | A1* | 12/2016 | Takenaka | F28D 1/0443 |
| 2019/0154321 | A1* | 5/2019 | Takenaka | F25B 47/02 |

FOREIGN PATENT DOCUMENTS

| | | |
|---|---|---|
| JP | 5236080 | 7/2013 |
| JP | 2018124046 | 8/2018 |
| KR | 20110073707 | 6/2011 |

OTHER PUBLICATIONS

EP extended European search report, in European Appln. No. 20173850.7, dated Oct. 20, 2020, 4 pages.

* cited by examiner

AIR CONDITIONING APPARATUS AND CONTROL METHOD THEREOF

CROSS-REFERENCE TO RELATED APPLICATIONS

The present application claims priority under 35 U.S.C. 119 and 35 U.S.C. 365 to Korean Patent Application No. 10-2019-0060850, filed on May 23, 2019, which is hereby incorporated by reference in its entirety.

TECHNICAL FIELD

The present disclosure relates to an air conditioning apparatus and a control method thereof.

BACKGROUND

Air conditioning apparatus can maintain air to be a suitable according to purposes in a certain space. In some example, the air conditioning apparatus may include a compressor, a condenser, an expansion device, and an evaporator. The air conditioning apparatus may perform a refrigerating cycle including compression, condensation, expansion, and evaporation processes with refrigerant to cool or heat the certain space.

The air conditioning apparatus may be used in various places.

In some cases, when the air conditioning apparatus performs a cooling operation, an outdoor heat exchanger provided in an outdoor unit may operate as a condenser and an indoor heat exchanger provided in an indoor unit may operate as an evaporator. In some cases, when the air conditioning apparatus performs a heating operation, the indoor heat exchanger may operate as a condenser and the outdoor heat exchanger may operate as an evaporator.

Recently, types of a refrigerant used in the air conditioning apparatus and a charge amount of refrigerant may be limited according to environmental regulations. In some cases, in order to ensure safety against leakage of the refrigerant, it may be required for a refrigerant line circulating in the air conditioning apparatus to be limitedly installed in an indoor space.

In some examples, the air conditioning apparatus may perform cooling or heating by performing heat exchange between a refrigerant and a certain fluid such as water.

In some cases, the air conditioning apparatus may include a plurality of heat exchangers for heat exchange between the refrigerant and water. Each of the plurality of heat exchangers may be operated as an evaporator or a condenser in a refrigerating cycle. The air conditioning apparatus may simultaneously provide cooling and heating from one outdoor unit to a plurality of rooms according to operation modes of the heat exchanger.

In some examples, an operation in which the plurality of heat exchangers operate in the same operation mode is called an "exclusive operation." The exclusive operation may be understood as a case where the plurality of heat exchangers are operated only as evaporators or as condensers. Here, the plurality of heat exchangers are based on an operating (ON) heat exchanger, not a stopped (OFF) heat exchanger.

In some examples, an operation in which operation modes of the plurality of heat exchangers are different from each other is called a "simultaneous operation." The simultaneous operation may be understood as a case where some of the plurality of heat exchangers are operated as condensers and the others are operated as evaporators.

In some cases, an air conditioning apparatus may include two four-way valves connected to a refrigerant flow path so that the heat exchanger is operated as an evaporator or a condenser. That is, the air conditioning apparatus may determine an operation mode of the heat exchanger through control of the four-way valve.

In some cases, the operation mode of the heat exchanger is designated. That is, a heat exchanger acting as an evaporator and a heat exchanger acting as a condenser are fixed. Accordingly, when the simultaneous operation is performed, loads of the heat exchangers may be different from each other, which may cause weakening of heating or cooling of a room.

In some cases, when the operation mode of the heat exchanger is switched, an operating frequency of the compressor may repeatedly rise and fall to cause a cycle hunting phenomenon that the cycle is unstable.

In some cases, when a switching operation of the four-way valve is performed to switch the operation mode of the heat exchanger, a pressure of the refrigerant which enters and exits the heat exchanger may rapidly change.

In some cases, where a pressure difference of the refrigerant in switching the operation mode of the heat exchanger, large noise may occur when the operation mode of the heat exchanger is switched.

In some cases, the operating frequency (Hz) of the compressor may be reduced or the compressor may be stopped if the pressure difference of the refrigerant is to be minimized to smooth switching of the four-way valve.

In some cases, the stop of the compressor or the reduction in the operating frequency of the compressor may weaken cooling or heating of an indoor unit which is to normally maintain cooling or heating. As a result, performance of the air conditioning apparatus may be reduced and comfort of an occupant may be also reduced.

In some cases, when the operation mode of the heat exchanger is switched, an indoor unit matching method for maintaining cycle performance may not be provided. That is, a load difference of the heat exchangers may not be minimized when the operation mode of the heat exchanger is switched. Further, the indoor unit and the heat exchanger in which water circulates may not be matched (or connected) to constantly maintain cooling performance and heating performance.

In some cases, when the operation of the indoor unit is stopped or temporarily switched to another mode, switching of the operation mode of the heat exchanger may cause unnecessary power consumption. Thus, it may be difficult to provide efficient heating and cooling to an indoor area.

SUMMARY

The present disclosure describes an air conditioning apparatus and a control method thereof.

The present disclosure describes an air conditioning apparatus and a control method thereof, capable of switching an operation mode of a heat exchanger, while maintaining cooling or heating performance provided to a plurality of rooms.

The present disclosure also describes an air conditioning apparatus and a control method thereof, in which an operation mode of a heat exchanger can be switched to a condenser or an evaporator to maintain efficiency of a cycle according to a variable operation of a plurality of indoor units.

The present disclosure further describes an air conditioning apparatus and a control method thereof, in which an operating frequency of a compressor is maintained at a certain operating level when an operation mode of a heat exchanger is switched.

The present disclosure describes an air conditioning apparatus and a control method thereof, capable of balancing a load applied to each heat exchanger when an operation mode of an indoor unit is switched.

The present disclosure describes an air conditioning apparatus and a control method thereof, for matching (or connecting) a plurality of heat exchangers and a plurality of indoor units to maintain optimal cooling and heating performance according to a change of an operation mode of the plurality of indoor units.

The present disclosure describes an air conditioning apparatus and a control method thereof, in which an operation of a heat exchanger is controlled in consideration of an indoor environment if an operation of an indoor unit or temporarily switched to another mode, thereby preventing unnecessary power consumption and efficiently providing cooling and heating to a room.

According to one aspect of the subject matter described in this application, an air conditioning apparatus includes an outdoor unit that is configured to circulate refrigerant and that includes a high pressure gas pipe, a low pressure gas pipe, and a liquid line; a plurality of indoor units configured to circulate water; a plurality of heat exchangers, each of which is configured to perform heat exchange between the outdoor unit and the plurality of indoor units; a high pressure guide pipe that connects the high pressure gas pipe to each of the plurality of heat exchangers; a low pressure guide pipe that extends from the low pressure gas pipe to the high pressure guide pipe; a liquid guide pipe that extends from the liquid line to each of the plurality of heat exchangers; and a controller. The controller is configured to: based on communication with the plurality of indoor units, determine an operation mode of each of the plurality of heat exchangers among an evaporator mode or a condenser mode; based on the operation mode, determine matching connections between the plurality of indoor units and the plurality of heat exchangers; and circulate the water through an indoor unit among the plurality of indoor units according to the matching connections.

Implementations according to this aspect may include one or more of the following features. For example, the controller may be configured to determine the matching connections to balance loads applied to the plurality of heat exchangers connected to the indoor unit at an initial operation of any one of the plurality of indoor units. In some examples, the controller may be configured to determine the matching connections to distribute a load corresponding to a capacity of the indoor unit to the plurality of heat exchangers at the initial operation.

In some implementations, the controller may be configured to: at the initial operation, determine an operation order of the plurality of indoor units based on capacities of the plurality of indoor units; and according to the operation order, sequentially set the matching connections between the plurality of indoor units and the plurality of heat exchangers. In some examples, all of the plurality of heat exchangers have one equal size.

In some implementations, the controller may be configured to: after the initial operation, perform a switchover operation in which the operation mode is changed based on a change event of operating indoor units that are connected to each of the plurality of heat exchangers; and in the switchover operation, count a number of the operating indoor units among the plurality of indoor units. In some examples, the change event of the operating indoor units may include: turning off one or more of the operating indoor units, or turning on, among the plurality of indoor units, an indoor unit that was in an OFF state.

In some implementations, the controller may be configured to switch the operation mode based on the number of the operating indoor units being less than a reference number. In some implementations, the controller may be configured to select the operation mode among the evaporator mode and the condenser mode according to an operation mode of one or more operating indoor units connected to the plurality of heat exchangers.

In some implementations, the air conditioning apparatus may further include: an outflow pipe that extends from at least one of the plurality of heat exchangers to an entrance of at least one of the plurality of indoor units, in which the outflow pipe is configured to circulate the water; an inflow pipe that extends from an exit of the at least one of the plurality of indoor units to the at least one of the plurality of heat exchangers; a pump installed at the inflow pipe and configured to apply pressure to the water in a direction to the at least one of the plurality of heat exchangers; an on/off valve installed at the outflow pipe and configured to control flow of water into each of the plurality of indoor units; and a flow path guide valve installed at the inflow pipe and configured to control flow of water discharged from each of the plurality of indoor units. In some examples, the controller may be configured to set a flow direction of the water based on opening and closing each of the on/off valve and the flow path guide valve.

In some implementations, the air conditioning apparatus may further include: a high pressure valve installed at the high pressure guide pipe; a low pressure valve installed at the low pressure guide pipe; and a flow valve installed at the liquid guide pipe. In some examples, the controller may be configured to set a flow direction of the refrigerant based on opening and closing each of the high pressure valve, the low pressure valve, and the flow valve.

According to another aspect, a method is described for controlling an air conditioning apparatus that includes a plurality of heat exchangers that are each configured to perform heat exchange between an outdoor unit configured to circulate refrigerant and a plurality of indoor units configured to circulate water. The method includes: performing an initial operation to start an operation of at least one of the plurality of indoor units; based on communication with an operating indoor unit among the plurality of indoor units, determining an operation mode of the operating indoor unit; determining whether to perform an exclusive operation of the plurality of heat exchangers corresponding to the operation mode of the operating indoor unit; and based on determining to perform the exclusive operation, performing a matching operation to connect the operating indoor unit to the plurality of heat exchangers according to an initial connection setting that is predetermined to distribute a load corresponding to a capacity of the operating indoor unit to the plurality of heat exchangers connected to the operating indoor unit.

Implementations according to this aspect may include one or more of the following features. For example, performing the matching operation may include: determining an operation order of the plurality of indoor units based on capacities of the plurality of indoor units; and according to the operation order, setting matching connections between the plurality of indoor units and the plurality of heat exchangers.

In some implementations, the method may further include: determining whether to perform a simultaneous operation in which the plurality of heat exchangers are operated in different operation modes; and based on determining to perform the simultaneous operation, communicating with a first indoor unit among the plurality of indoor units and determining a first operation mode of the first indoor unit. Performing the matching operation may include: connecting the first indoor unit to one of the plurality of heat exchangers; and connecting remaining indoor units among the plurality of indoor units to one or more of the plurality of heat exchangers.

In some implementations, performing the matching operation may further include: determining a first heat exchanger connected to the first indoor unit based on the matching operation; determining to operate a second indoor unit among the remaining indoor units in the first operation mode; and connecting the second indoor unit to the first heat exchanger.

In some implementations, the method may further include: determining to operate a third indoor unit among the remaining indoor units in a mode different from the first operation mode, where performing the matching operation includes connecting the third indoor unit to a second heat exchanger among the plurality of heat exchangers that is different from the first heat exchanger.

In some implementations, the method may further include: after the initial operation, performing a switchover operation to switch an operation mode of the plurality of heat exchangers based on a change event of the operating indoor unit, where the change event of the operating indoor unit includes: turning off the operating indoor unit, changing the operation mode of the operating indoor unit, and turning on, among the plurality of indoor units, an indoor unit that was in an OFF state.

In some examples, performing the switchover operation may include: determining whether at least one of the plurality of heat exchangers performs the exclusive operation; based on a determination that the at least one of the plurality of heat exchangers performs the exclusive operation, counting a number of operating indoor units that are connected to each of the plurality of heat exchangers; based on the number of operating indoor units being less that a reference number, determining one of the plurality of heat exchangers as a switchover heat exchanger; and switching an operation mode of the switchover heat exchanger to a condenser mode or an evaporator mode.

In some implementations, it may be possible to improve comfort of an occupant by switching an operation mode of the heat exchangers without weakening cooling or heating provided to a plurality of rooms.

In some implementations, it may be possible to reduce unnecessary power consumption by switching the operation mode of the heat exchangers without having to vary an operation of the compressor.

In some implementations, the indoor unit and the heat exchanger may be connected to provide optimal cycle efficiency according to a case where a plurality of indoor units changes the operation mode.

In some implementations, since there is no need to reduce the operating frequency of the compressor or to stop the entire system to switch the operation mode of the heat exchanger, cooling or heating of a room may be continuously maintained at a predetermined level or higher.

In some implementations, cycle hunting of the compressor during the switching operation of the heat exchanger may be minimized.

In some implementations, when the operation of the plurality of indoor units is switched, loads applied to each heat exchanger may be balanced, thereby maintaining and improving heat exchange performance between the refrigerant and water.

BRIEF DESCRIPTION OF THE DRAWINGS

The accompanying drawings, which are included to provide a further understanding of the disclosure and are incorporated in and constitute a part of this application, illustrate implementations of the disclosure and together with the description serve to explain the principle of the disclosure.

DETAILED DESCRIPTION

Reference will now be made in detail to the implementations of the present disclosure, examples of which are illustrated in the accompanying drawings.

In the following detailed description of the preferred implementations, reference is made to the accompanying drawings that form a part hereof, and in which is shown by way of illustration specific preferred implementations in which the invention may be practiced. These implementations are described in sufficient detail to enable those skilled in the art to practice the invention, and it is understood that other implementations may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of implementations, terms such as first, second, A, B, (a), (b) or the like may be used herein when describing components of the present disclosure. Each of these terminologies is not used to define an essence, order or sequence of a corresponding component but used merely to distinguish the corresponding component from other component(s).

Figure 1:
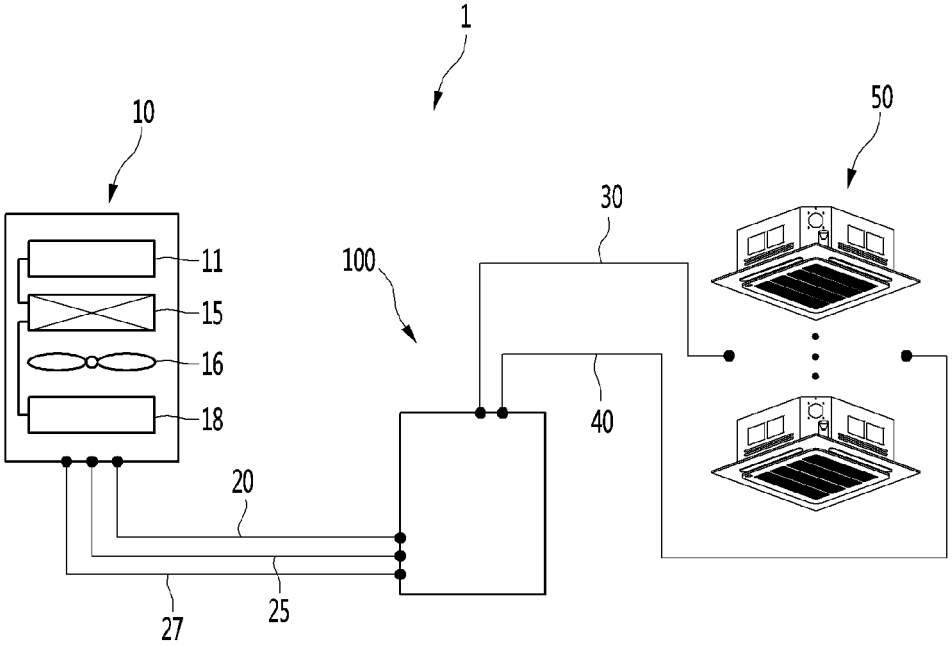
FIG. 1 is a schematic view showing an example of an air conditioning apparatus.

FIG. 1 is a schematic view showing an example of an air conditioning apparatus.

Referring to FIG. 1, an air conditioning apparatus 1 may include an outdoor unit 10, an indoor unit 50, and a heat exchange device 100 in which a refrigerant circulating in the outdoor unit 10 and water circulating in the indoor unit 50 are heat exchanged.

The heat exchange device 100 may include a heat exchangers 101 and 102 in which a coolant and a refrigerant are heat exchanged and a switching unit R controlling a flow of the refrigerant. The switching unit R may connect the heat exchangers 101 and 102 to the outdoor unit 10 (see FIG. 2).

Here, the outdoor unit 10 may include a simultaneous cooling and heating type outdoor unit.

The switching unit R may switch a flow direction of the refrigerant according to an operation of a provided valve. Further, the switching unit R may adjust a flow rate of the refrigerant according to the operation of the valve.

The outdoor unit 10 and the heat exchange device 100 may be fluidly connected by a first fluid. For example, the first fluid may include a refrigerant.

The refrigerant may flow to circulate in a refrigerant flow path provided in the heat exchange device 100 and the outdoor unit 10.

The outdoor unit 10 may include a compressor 11 and an outdoor heat exchanger 15.

An outdoor fan 16 may be provided on one side of the outdoor heat exchanger 15.

The outdoor fan 16 may blow ambient air toward the outdoor heat exchanger 15. By the driving of the outdoor fan 16, heat exchange may be performed between ambient air and the refrigerant of the outdoor heat exchanger 15.

The outdoor unit 10 may further include a main expansion valve 18 (EEV).

The air conditioning apparatus 1 may further include three pipes 20, 25, and 27 connecting the outdoor unit 10 and the heat exchange device 100.

The three pipes 20, 25, and 27 may include a high pressure gas pipe 20 through which a high-pressure gas phase refrigerant flows, a low pressure gas pipe 25 through which a low-pressure gas phase refrigerant flows, and the liquid line 27 through which the liquid flows.

In some examples, the high pressure gas pipe 20 may be connected to a discharge side of the compressor 11. The low pressure gas pipe 25 may be connected to a suction side of the compressor 11. That is, the refrigerant flowing through the low pressure gas pipe 25 may form a lower pressure than the refrigerant flowing through the high pressure gas pipe 20. The liquid line 27 may be connected to the outdoor heat exchanger 15.

That is, the outdoor unit 10 and the heat exchange device 100 may have a "three pipe connection structure." The refrigerant may circulate in the outdoor unit 10 and the heat exchange device 100 through the three pipes 20, 25, and 27.

The heat exchange device 100 and the indoor unit 50 may be fluidly connected by a second fluid. In some examples, the second fluid may include water.

The water may flow a water flow path provided in the heat exchange device 100 and the indoor unit 50. That is, the heat exchangers 101 and 102 may be provided so that a refrigerant flow path and the water flow path exchange heat with each other. For example, the heat exchangers 101 and 102 may include a plate heat exchanger capable of exchanging heat between water and a refrigerant.

The indoor unit 50 may include a plurality of indoor units 51, 52, 53, and 54.

The plurality of indoor units 50 may each include an indoor heat exchanger in which indoor air and water exchange heat and an indoor fan that provides air blowing from one side of the indoor heat exchanger.

The air conditioning apparatus 1 may further include water pipes 30 and 40 for guiding water flowing to circulate in the indoor unit 50 and the heat exchange device 100. The water pipes 30 and 40 may form a water circulation cycle W (see FIG. 2).

The water pipes 30 and 40 may include an outflow pipe 30 connecting the heat exchange device 100 to one side of the indoor unit 50 and an inflow pipe 40 connecting the heat exchange device 100 to the other side of the indoor unit 50.

The inflow pipe 40 may be connected to an outlet of the indoor unit 50 and guide water passing through the indoor unit 50 to the heat exchange device 100.

The outflow pipe 30 may be connected to an inlet of the indoor unit 50 and guide water discharged from the heat exchange device 100 to the indoor unit 50.

That is, the water may circulate in the heat exchange device 100 and the indoor unit 50 through the water pipes 30 and 40.

In some implementations, the refrigerant circulating in the outdoor unit 10 and the heat exchange device 100 and the water circulating in the heat exchange device 100 and the indoor unit 50 may exchange heat through the heat exchangers 101 and 102 provided in the heat exchange device 100.

The water cooled or heated by the heat exchange may be heat exchanged with the indoor heat exchanger provided in the indoor unit 50 to perform cooling or heating of an indoor space.

For example, the cooled water releasing heat from the refrigerant may be circulated in the indoor unit 50 operated in a cooling mode. Further, heated water absorbing heat from the refrigerant may circulate in the indoor unit 50 operated in a heating mode. Accordingly, indoor air intaken by an indoor fan may be cooled or heated and discharged back to the room.

Figure 2:
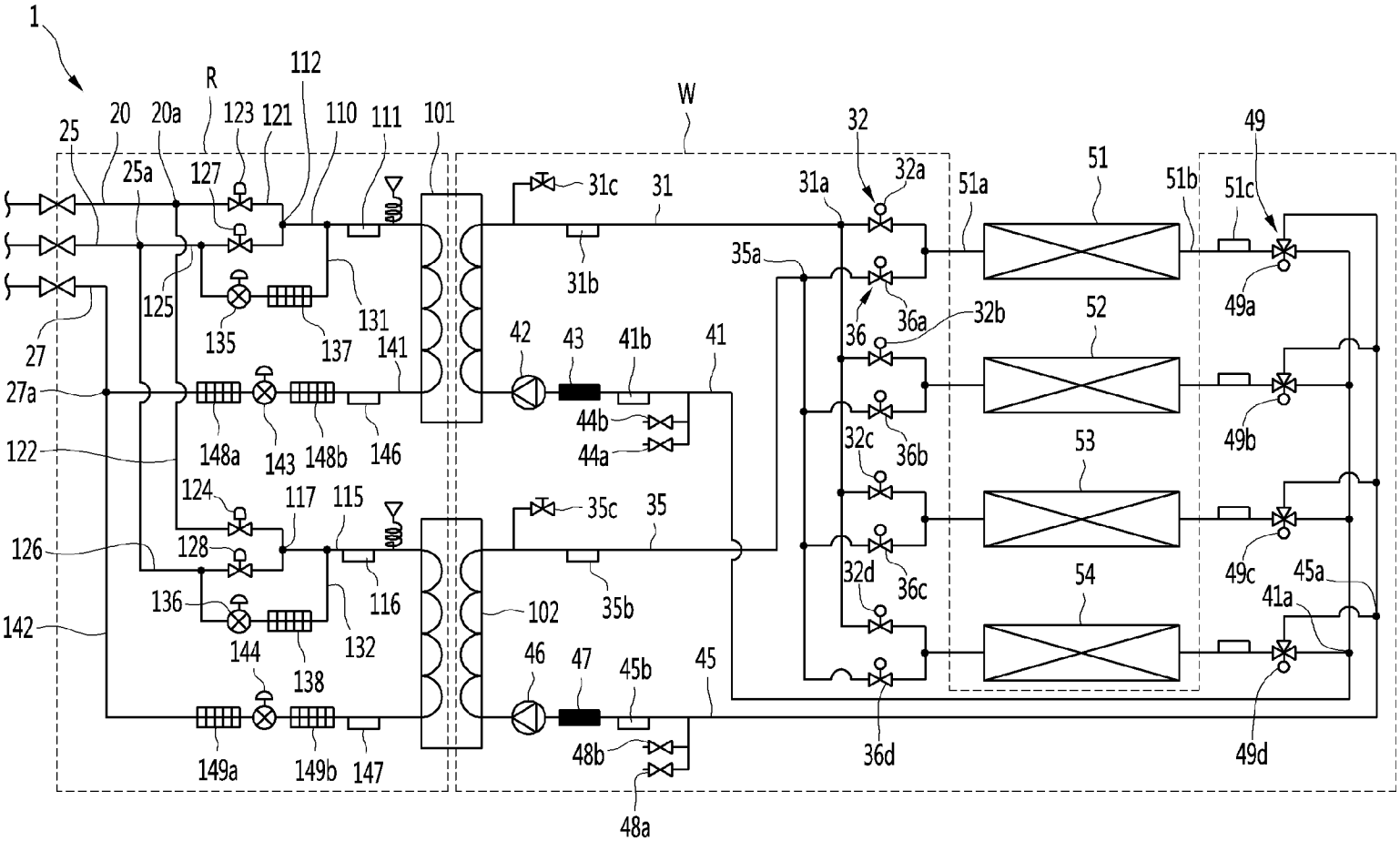
FIG. 2 is a view showing a configuration of an example of an air conditioning apparatus.

FIG. 2 is a view showing a configuration of an example of an air conditioning apparatus.

A water circulation cycle W circulating in the heat exchange device 100 and the indoor unit 50 and the heat exchange device 100 will be described in detail.

Referring to FIG. 2, the heat exchange device 100 may include the heat exchangers 101 and 102 in which the first fluid and the second fluid exchange heat.

As described above, the first fluid includes a refrigerant, and the second fluid includes water.

And the heat exchangers 101 and 102 may be provided in plurality to provide both cooling and heating to the indoor unit 50. For example, the heat exchangers 101 and 102 may include a first heat exchanger 101 and a second heat exchanger 102. The first heat exchanger 101 and the second heat exchanger 102 may have the same size and capacity.

Hereinafter, a case where the two heat exchangers 101 and 102 are provided will be described to help understand the heat exchangers 101 and 102 which may be selectively switched in an operation mode.

However, the number of the heat exchangers 101 and 102 is not limited thereto.

Therefore, water may selectively flow into the first heat exchanger 101 or the second heat exchanger 102 to exchange heat with the refrigerant according to an indoor unit operating in the cooling or heating mode.

The heat exchangers 101 and 102 may include a plate heat exchanger. For example, the heat exchangers 101 and 102 may be configured such that a flow path through which the refrigerant flows and a flow path through which water flows are alternately stacked.

Further, the heat exchange device 100 may further include the switching unit R connecting the heat exchangers 101 and 102 and the outdoor unit 10.

The switching unit R may control a flow direction and a flow rate of the refrigerant circulating in the first heat exchanger 101 and the second heat exchanger 102. Details of the switching unit R will be described later.

The indoor unit 50 may be provided in plurality. For example, the indoor unit 50 may include a first indoor unit 51, a second indoor unit 52, a third indoor unit 53, and a fourth indoor unit 54. The number of the indoor unit 50 is not limited thereto.

As described above, the indoor unit 50 and the heat exchange device 100 may be connected by the water pipes 30 and 40 through which water flows. Further, the water pipes 30 and 40 may form a water circulation cycle W circulating in the indoor unit 50 and the heat exchange device 100. That is, the water may flow in the heat exchangers 101 and 102 and the indoor unit 50 through the water pipes 30 and 40.

Specifically, the water pipes 30 and 40 may include inflow pipes 41 and 45 guiding water to flow into the heat exchangers 101 and 102 and outflow pipes 31 and 35 guiding water discharged from the heat exchangers 101 and 102.

The inflow pipes 41 and 45 may guide the water passing through the indoor unit 50 to the heat exchangers 101 and 102. The outflow pipes 31 and 35 may guide water passing through the heat exchangers 101 and 102 to flow to the indoor unit 50.

The inflow pipes 41 and 45 may include a first inflow pipe 41 to guide the water to the first heat exchanger 101 and a second inflow pipe 45 to guide the water to the second heat exchanger 102.

The outflow pipes 31 and 35 may include a first outflow pipe 31 guiding water passing through the first heat exchanger 101 to the indoor unit 50 and a second outflow pipe 35 guiding the water passing through the second heat exchanger 102 to the indoor unit 50.

In more detail, the first inflow pipe 41 may extend to a water inlet of the first heat exchanger 101. The first outflow pipe 31 may extend from a water outlet of the first heat exchanger 101.

Similarly, the second inflow pipe 45 may extend to a water inlet of the second heat exchanger 102. The second outflow pipe 35 may extend from the water outlet of the second heat exchanger 102.

The outflow pipes 31 and 35 may extend to the indoor units 51, 52, 53, and 54 from the water outlet of the heat exchangers 101 and 102.

Therefore, the water introduced into the water inlet of the heat exchangers 101 and 102 from the inflow pipes 41 and 45 may be heat exchanged with the refrigerant and flow into the outflow pipes 31 and 35 through the water outlet of the heat exchangers 101 and 102.

The air conditioning apparatus 1 may further include pumps 42 and 46 installed on the inflow pipes 41 and 45.

The pumps 42 and 46 may provide pressure to direct the water in the inflow pipes 41 and 45 to the heat exchangers 101 and 102. That is, the pumps 42 and 46 may be installed in the water pipe to set a flow direction of the second fluid.

The pumps 42 and 46 may include a first pump 42 installed in the first inflow pipe 41 and a second pump 46 installed in the second inflow pipe 45.

The pumps 42 and 46 may force the flow of water. For example, when the first pump 42 is driven, water may circulate in the indoor unit 50 and the first heat exchanger 101.

That is, the first pump 42 may provide circulation of water through the first inflow pipe 41, the first heat exchanger 101, the first outflow pipe 31, the indoor inflow pipe 51*a*, the indoor unit 51, 52, 53, and 54, and an indoor outflow pipe 51*b*.

The air conditioning apparatus 1 may further include water supply valves 44*a* and 48*a* and relief valves 44*b* and 48*b* installed at a pipe branched from the inflow pipes 41 and 45.

The water supply valves 44*a* and 48*a* may provide or limit water to the inflow pipes 41 and 45 through an opening and closing operation.

The water supply valves 44*a* and 48*a* may include a first water supply valve 44*a* opened and closed to provide water to the first inflow pipe 44 and a second inflow pipe 45 opened and closed to provide water to the second inflow pipe 45.

In some examples, the relief valves 44*b* and 48*b* may be provided to eject pressure in case of emergency when pressure inside the water pipe exceeds a designed pressure through an opening and closing operation. The relief valves 44*b* and 48*b* may be referred to as safety valves.

The relief valves 44*b* and 48*b* may include a first relief valve 44*b* installed at a pipe connected to the first inflow pipe 41 and a second relief valve 48*b* installed at a pipe connected to the second inflow pipe 45.

The air conditioning apparatus 1 may further include water pipe strainers 43 and 47 and inflow sensors 41*b* and 45*b* installed at the inflow pipes 41 and 45.

The water pipe strainers 43 and 47 may be provided to filter waste products in the water flowing through the water pipe. For example, the water pipe strainers 43 and 47 may be formed of a metal mesh.

The water pipe strainers 43 and 47 may include a strainer 43 installed at the first inflow pipe 41 and a strainer 47 installed at the second inflow pipe 45.

The water pipe strainers 43 and 47 may be located at an entrance side of the pumps 42 and 46.

The inflow sensors 41*b* and 45*b* may detect a state of water flowing in the inflow pipes 41 and 45. For example, the inflow sensors 41*b* and 45*b* may be provided as sensors for detecting temperature and pressure.

The inflow sensors 41*b* and 45*b* may include a first inflow sensor 41*b* installed at the first inflow pipe 41 and a second inflow sensor 45*b* is installed at the second inflow pipe 45.

The air conditioning apparatus 1 may further include purge valves 31*c* and 35*c* installed at the outflow pipes 31 and 35.

Specifically, the purge valves 31*c* and 35*c* may include a first purge valve 31*c* installed at the first outflow pipe 31 and a second purge valve 35*c* installed at the second outflow pipe 35.

The purge valves 31*c* and 35*c* may discharge air inside the water pipe to the outside by an opening and closing operation.

The air conditioning apparatus 1 may further include temperature sensors 31*b* and 35*b* installed at the outflow pipes 31 and 35.

The temperature sensors 31*b* and 35*b* may detect a state the water heat exchanged with the refrigerant. For example, the temperature sensors 31*b* and 35*b* may include a thermistor temperature sensor.

The temperature sensors 31*b* and 35*b* may include a first temperature sensor 31*b* installed on the first outflow pipe 31 and a second temperature sensor 35*b* installed on the second outflow pipe 35.

The outflow pipes 31 and 35 may be branched and extend to each inlet side of the plurality of indoor units 51, 52, 53, and 54.

That is, a branch point 31*a* branched to each of the indoor units 51, 52, 53, and 54 may be formed at one end of the outflow pipes 31 and 35. The outflow pipes 31 and 35 may be branched from the branch point 31*a* and extend to the indoor inflow pipe 51*a* coupled to an entrance of each of the indoor units 51, 52, 53, and 54.

That is, the water pipe may further include an indoor inflow pipe 51*a* coupled to the entrance of the indoor units 51, 52, 53, and 54.

The indoor inflow pipe 51*a* may include a first indoor inflow pipe 51*a* coupled to the entrance of the first indoor unit 51, a second indoor inflow pipe coupled to the entrance of the second indoor unit 52, a third indoor inflow pipe coupled to the entrance of the third indoor unit 53, and a fourth indoor inflow pipe coupled to the entrance of the fourth indoor unit 54.

The first outflow pipe 31 may form a first branch point 31*a* branched to each indoor inflow pipe 51*a*. The second outflow pipe 35 may form a second branch point 35*a* branched to each indoor inflow pipe 51*a*.

That is, the first outflow pipe 31 branched and extending from the first branch point 31*a* and the second outflow pipe 35 branched and extending from the second branch point 35*a* may join the indoor inflow pipe 51*a*.

The air conditioning apparatus 1 may further include on/off valves 32 and 36 for adjusting a flow rate of water introduced into the indoor unit 50.

The on/off valves 32 and 36 may limit a flow rate and flow of water introduced into the indoor inflow pipe 51*a* through the opening and closing operation.

That is, the on/off valves 32 and 36 may include a first on/off valve 32 installed on the first outflow pipe 31 and a second on/off valve 36 installed on the second outflow pipe 35.

Specifically, the first on/off valve 32 may be branched from the first branch point 31*a* and installed on a pipe extending to each indoor inflow pipe 51*a*.

That is, the first on/off valve 32 may be installed on each pipe branched from the first branch point 31*a*. Therefore, the first on/off valve 32 may be provided corresponding to the number of the indoor unit 50.

In some examples, the first on/off valve 32 may include a valve 32*a* installed on a pipe connected to the first indoor unit 51, a valve 32*b* installed on a pipe connected to the second indoor unit 52, a valve 32*c* installed on a pipe connected to the third indoor unit 53, and a valve 32*d* installed on a pipe connected to the fourth indoor unit 54.

The second on/off valve 36 may be installed on a pipe branched from the second branch point 35*a* and extending to each indoor inflow pipe 51*a*.

That is, the second on/off valve 36 may be installed on each pipe branched from the second branch point 35*a*. Therefore, the second on/off valve 36 may be provided to correspond to the number of the indoor unit 50.

In some examples, the second on/off valve 36 may include a valve 36*a* installed on a pipe connected to the first indoor unit 51, a valve 36*b* installed on a pipe connected to the second indoor unit 52, a valve 36*c* installed on a pipe connected to the third indoor unit 53, and a valve 36*d* installed on a pipe connected to the fourth indoor unit 54.

The water pipe may further include an indoor outflow pipe 51*b* coupled to an outlet of the indoor units 51, 52, 53, and 54.

In some examples, the indoor outflow pipe 51*b* may include a first indoor outflow pipe 51*b* coupled to an outlet of the first indoor unit 51, a second indoor outflow pipe coupled to an outlet of the second indoor unit 52, a third indoor outflow pipe coupled to an outlet of the third indoor unit 53, and a fourth indoor outflow pipe coupled to an outlet of the fourth indoor unit 54.

The air conditioning apparatus 1 may further include a detection sensor 51*c* installed on the indoor outflow pipe 51*b*.

The detection sensor 51*c* may detect a state of water flowing in the indoor outflow pipe 51*b*. In some examples, the detection sensor 51*c* may be provided as a sensor for detecting a temperature and pressure of the water.

The detection sensor 51*c* may include a first detection sensor 51*d* installed at the first detection sensor 51*c*, a second detection sensor installed at the second indoor outflow pipe, a third detection sensor installed at the third indoor outflow pipe, and a fourth detection sensor installed at the fourth indoor outflow pipe.

The air conditioning apparatus 1 may further include a flow path guide valve 49 to which the indoor outflow pipe 51*b* is coupled.

The flow path guide valve 49 may control a flow direction of the water passing through the indoor unit 50 through the opening and closing operation. That is, the flow path guide valve 49 may be controlled to switch a flow direction of water.

In some examples, the flow path guide valve 49 may include a three-way valve.

Specifically, the flow path guide valve 49 may include a first flow path guide valve 49*a* installed at the first indoor outflow pipe 51*b*, a second flow path guide valve 49*b* installed at the second indoor outflow pipe, a third flow path guide valve 49*c* installed at the third indoor outflow pipe, and a fourth flow path guide valve 49*d* installed at the fourth indoor outflow pipe.

The flow path guide valve 49 may be located at a joint point where the pipes branched from the inflow pipes 41 and 45 and extending to the respective indoor units 51, 52, 53, and 54 are connected to the respective indoor outflow pipes 51*b*.

Specifically, the indoor outflow pipe 51*b* may be coupled to a first port of the flow path guide valve 49, a pipe branched and extending from the first inflow pipe 41 may be coupled to a second port, and a pipe branched and extending from the second inflow pipe 45 may be coupled to a third port.

Thus, the water passing through the indoor units 51, 52, 53, and 54 may flow to the first heat exchanger 101 or the second heat exchanger 102 operating in the cooling or heating mode by the opening and closing operation of the flow path guide valve 49.

That is, the flow path guide valve 49 may be installed at the inflow pipes 41 and 45 to control a flow of water discharged from the outlet of each of the indoor units 51, 52, 53, and 54.

The inflow pipes 41 and 45 may form branch points 41*a* and 45*a* branched to each of the indoor units 51, 52, 53, and 54.

Specifically, the first inflow pipe 41 may form a first branch point 41*a* branched to each of the indoor units 51, 52, 53, and 54.

That is, the first inflow pipe 41 may be branched from the first branch point 41*a* and extend toward each of the indoor unit 51, 52, 53, and 54. The first inflow pipe 41 branched and extending from the first branch point 41*a* may be coupled to the flow path guide valve 49.

The second inflow pipe 45 may form a second branch point 45*a* branched to each of the indoor units 51, 52, 53, and 54.

That is, the second inflow pipe 45 may be branched from the second branch point 45*a* and extend toward each of the indoor unit 51, 52, 53, and 54. The second inflow pipe 45 branched from the second branch point 45*a* may be coupled to the flow path guide valve 49.

In some examples, branch points 41*a* and 45*a* formed by the inflow pipes 41 and 45 may be referred to as "inflow pipe branch point." The branch points 31*a* and 35*a* formed by the outflow pipes 31 and 35 may be referred to as "outflow pipe branch points."

In some examples, the heat exchange device 100 may include a switching unit R for adjusting a flow direction and a flow rate of the refrigerant entering and exiting the first heat exchanger 101 and the second heat exchanger 102.

Specifically, the switching unit R may include refrigerant pipes 110 and 115 coupled to one side of the heat exchangers 101 and 102 and liquid guide pipes 141 and 142 coupled to the other side of the heat exchangers 101 and 102.

The refrigerant pipes 110 and 115 may be coupled to a refrigerant entrance formed on one side of the heat exchangers 101 and 102. The liquid guide pipes 141 and 142 may be coupled to a refrigerant entrance formed on the other side of the heat exchangers 101 and 102.

Accordingly, the refrigerant pipes 110 and 115 and the liquid guide pipes 141 and 142 may be connected to a refrigerant flow path provided at the heat exchangers 101 and 102 to heat exchange with the water.

The refrigerant pipes 110 and 115 and the liquid guide pipes 141 and 142 may guide the refrigerant to pass through the heat exchangers 101 and 102.

Specifically, the refrigerant pipes 110 and 115 may include a first refrigerant pipe 110 coupled to one side of the first heat exchanger 101 and a second refrigerant pipe 115 coupled to one side of the second heat exchanger 102.

Further, the liquid guide pipes 141 and 142 may include a first liquid guide pipe 141 coupled to the other side of the first heat exchanger 101 and a second liquid guide pipe 142 coupled to the other side of the second heat exchanger 102.

In some examples, the refrigerant may circulate in the first heat exchanger 101 by the first refrigerant pipe 110 and the first liquid guide pipe 141. The refrigerant may circulate in the second heat exchanger 102 by the second refrigerant pipe 115 and the second liquid guide pipe 142.

The liquid guide pipes 141 and 142 may be connected to the liquid line 27.

Specifically, the liquid line 27 may form a liquid line branch point 27*a* branched to the first liquid guide pipe 141 and the second liquid guide pipe 142.

That is, the first liquid guide pipe 141 may extend from the liquid line branch point 27*a* to the first heat exchanger 101, and the second liquid guide pipe 142 may extend from the liquid line branch point 27*a* to the second heat exchanger 102.

The air conditioning apparatus 1 may further include gas phase refrigerant sensors 111 and 116 installed at the refrigerant pipes 110 and 115 and liquid refrigerant sensors 146 and 147 installed at the liquid guide pipes 141 and 142.

The gas phase refrigerant sensors 111 and 116 and the liquid refrigerant sensors 146 and 147 may together be referred to as "refrigerant sensors."

The refrigerant sensor may detect a state of the refrigerant flowing through the refrigerant pipes 110 and 115 and the liquid guide pipes 141 and 142. For example, the refrigerant sensor may detect a temperature and pressure of the refrigerant.

The gas phase refrigerant sensors 111 and 116 may include a first gas phase refrigerant sensors 111 installed at the first refrigerant pipe 110 and a second gas phase refrigerant sensor 116 installed at the second refrigerant pipe 115.

The liquid refrigerant sensors 146 and 147 may include a first liquid refrigerant sensor 146 installed at the first liquid refrigerant sensor 146 and a second liquid refrigerant sensor 147 installed at the second liquid guide pipe 142.

Further, the air conditioning apparatus 1 may further include flow valves 143 and 144 and strainers 148*a*, 148*b*, 149*a*, and 149*b* installed on both sides of the flow valves 143 and 144.

The flow valves 143 and 144 may adjust a flow rate of the refrigerant by adjusting an opening degree.

The flow valves 143 and 144 may include an electronic expansion valve (EEV). The flow valves 143 and 144 may adjust a pressure of the refrigerant passing by adjusting the opening degree.

The flow valves 143 and 144 may include a first flow valve 143 installed at the first liquid guide pipe 141 and a second flow valve 144 installed at the second liquid guide pipe 142.

The strainers 148*a*, 148*b*, 149*a*, and 149*b* may be provided to filter wastes of the refrigerant flowing through the liquid guide pipes 141 and 142. For example, the strainers 148*a*, 148*b*, 149*a*, and 149*b* may be formed of a metal mesh.

The strainers 148*a*, 148*b*, 149*a*, and 149*b* may include first strainers 148*a* and 148*b* installed at the first liquid guide pipe 141 and second strainers 149*a* and 149*b* installed at the second liquid guide pipe 142.

The first strainers 148*a* and 148*b* may include a strainer 148*a* installed on one side of the first flow valve 143 and a strainer 148*b* installed on the other side of the first flow valve 143. Accordingly, the waste may be filtered even if a flow direction of the refrigerant is changed.

Similarly, the second strainers 149*a* and 149*b* may include a strainer 149*a* installed on one side of the second flow valve 144 and a strainer 149*b* installed on the other side of the second flow valve 144.

The refrigerant pipes 110 and 115 may be connected to the high pressure gas pipe 20 and the low pressure gas pipe 25. The liquid guide pipes 141 and 142 may be connected to the liquid line 27.

Specifically, the refrigerant pipes 110 and 115 may form refrigerant branch points 112 and 117 at one end thereof. The high pressure gas pipe 20 and the low pressure gas pipe 25 may be connected to join each other at the refrigerant branch points 112 and 117.

That is, the refrigerant branch points 112 and 117 may be formed at one end of the refrigerant pipes 110 and 115, and the other end may be coupled with the refrigerant entrance of the heat exchangers 101 and 102.

The switching unit R may further include high pressure guide pipes 121 and 122 extending from the high pressure gas pipe 20 to the refrigerant pipes 110 and 115.

That is, the high pressure guide pipes 121 and 122 may connect the high pressure gas pipe 20 and the refrigerant pipes 110 and 115.

In some examples, the high pressure guide pipes 121 and 122 may be formed integrally with the refrigerant pipes 110 and 115. That is, the refrigerant pipes 110 and 115 may be included in the high pressure guide pipes 121 and 122.

The high pressure guide pipes 121 and 122 may be branched from a high pressure branch point 20*a* of the high pressure gas pipe 20 and extend to the refrigerant pipes 110 and 115.

Specifically, the high pressure guide pipes 121 and 122 may include a first high guide pipe 121 extending from the high pressure branch point 20*a* to the first refrigerant pipe 110 and a second high pressure guide pipe 122 extending from the high pressure branch point 20*a* to the second refrigerant pipe 115.

The first high pressure guide pipe 121 may be connected to the first refrigerant branch point 112, and the second high pressure guide pipe 122 may be connected to the second refrigerant branch 117.

That is, the first high pressure guide pipe 121 may extend from the high pressure branch point 20*a* to the first refrigerant branch point 112, and the second high pressure guide pipe 122 may extend from the high pressure branch point to the second refrigerant branch point 117.

The air conditioning apparatus 1 may further include high pressure valves 123 and 124 installed on the high pressure guide pipes 121 and 122.

The high pressure valves 123 and 124 may limit a flow of the refrigerant to the high pressure guide pipes 121 and 122 through the opening and closing operation.

The high pressure valves 123 and 124 may include a first high pressure valve 123 installed on the first high pressure valve 123 installed at the first high pressure guide pipe 121 and a second high pressure valve 124 installed at the second high pressure guide pipe 122.

The first high pressure valve 123 may be installed between the high pressure branch point 20*a* and the first refrigerant branch point 112.

The second high pressure valve 124 may be installed between the high pressure branch point 20*a* and the second refrigerant branch point 117.

The first high pressure valve 123 may control a flow of the refrigerant between the high pressure gas pipe 20 and the first refrigerant pipe 110. The second high pressure valve 124 may control a flow of the refrigerant between the high pressure gas pipe 20 and the second refrigerant pipe 115.

The switching unit R may further include low pressure guide pipes 125 and 126 extending from the low pressure pipe 25 to the refrigerant pipes 110 and 115.

That is, the low pressure guide pipes 125 and 126 may connect the low pressure pipe 25 and the refrigerant pipes 110 and 115.

The low pressure guide pipes 125 and 126 may be branched from the low pressure branch point 25*a* of the low pressure gas pipe 25 and extend to the refrigerant pipes 110 and 115.

Specifically, the low pressure guide pipes 125 and 126 may include a first low pressure guide pipe 125 extending from the low pressure branch point 25*a* to the first refrigerant pipe 110 and a second low pressure guide pipe 126 extending from the low pressure branch point 25*a* to the second refrigerant pipe 115.

The first low pressure guide pipe 125 may be connected to the first refrigerant branch point 112, and the second low pressure guide pipe 126 may be connected to the second refrigerant branch point 117.

That is, the first low pressure guide pipe 125 may extend from the low pressure branch point 25*a* to the first refrigerant branch point 112, and the second low pressure guide pipe 126 may extend from the low pressure branch point 25*a* to the second refrigerant branch point 117. Therefore, the high pressure guide pipes 121 and 122 and the low pressure guide pipes 125 and 126 may be connected to join each other at the refrigerant branch points 112 and 117.

The air conditioning apparatus 1 may further include low pressure valves 127 and 128 installed at the low pressure guide pipes 125 and 126.

The low pressure valves 127 and 128 may limit the flow of the refrigerant to the low pressure guide pipes 125 and 126 through the opening and closing operation.

The low pressure valves 127 and 128 may include a first low pressure valve 127 installed at the first low pressure guide pipe 125 and a second low pressure valve installed at the second low pressure guide pipe 126.

The first low pressure valve 127 may be installed between the first refrigerant branch point 112 and a point to which the first equilibrium pressure pipe 131 to be described later is connected.

The second low pressure valve 128 may be installed between the second refrigerant branch point 117 and a point to which a second equilibrium pressure pipe 132 to be described later is connected.

The switching unit R may further include equilibrium pressure pipes 131 and 132 branched from the refrigerant pipe 110 and extending to the low pressure guide pipes 125 and 126.

The equilibrium pressure pipes 131 and 132 may include a first equilibrium pressure pipe 131 branched from one point of the first refrigerant pipe 110 and extending to the first low pressure guide pipe 125 and a second equilibrium pressure pipe 132 branched from one point of the second refrigerant pipe 115 and extending to the second low pressure guide pipe 126.

The point where the equilibrium pressure pipes 131 and 132 and the low pressure guide pipes 125 and 126 are connected may be located between the low pressure branch point 25*a* and the low pressure valves 127 and 128.

That is, the first equilibrium pressure pipe 131 may be branched from the first refrigerant pipe 110 and extend to the first low pressure guide pipe 125 positioned between the low pressure branch point 25*a* and the first low pressure valve 127.

Similarly, the second equilibrium pressure pipe 132 may be branched from the second refrigerant pipe 115 and extend to the second low pressure guide pipe 126 positioned between the low pressure branch point 25*a* and the second low pressure valve 128.

The air conditioning apparatus 1 may further include equilibrium pressure valves 135 and 136 and equilibrium pressure strainers 137 and 138 installed at the equilibrium pressure pipes 131 and 132.

The equilibrium pressure valves 135 and 136 may bypass the refrigerant of the refrigerant pipes 110 and 115 to the low pressure guide pipes 125 and 126 by adjusting the opening degree.

The equilibrium pressure valves 135 and 136 may include an electronic expansion valve (EEV).

The equilibrium pressure valves 135 and 136 may include a first equilibrium pressure valve 135 installed at the first equilibrium pressure pipe 131 and a second equilibrium pressure valve 136 installed at the second equilibrium pressure pipe 132.

The equilibrium pressure strainers 137 and 138 may include a first equilibrium pressure strainer 137 installed at the first equilibrium pressure pipe 131 and a second equilibrium pressure strainer 138 installed at the second equilibrium pressure pipe 132.

The equilibrium pressure strainers 137 and 138 may be located between the equilibrium pressure valves 135 and 136 and the refrigerant pipes 110 and 115. Accordingly, wastes of the refrigerant flowing from the refrigerant pipes 110 and 115 to the equilibrium pressure valves 135 and 136 may be filtered or foreign substances may be prevented.

In some examples, the equilibrium pressure pipes 131 and 132 and the equilibrium pressure valves 135 and 136 may be called "equilibrium pressure circuits."

The equilibrium pressure circuits may be operated to reduce a pressure difference between a high pressure refrigerant and a low pressure refrigerant of the refrigerant pipes 110 and 115 when the operation modes of the heat exchangers 101 and 102 are switched.

Here, the operation modes of the heat exchangers 101 and 102 may include a condenser mode to operate as a condenser and an evaporator mode to operate as an evaporator.

In some examples, when the heat exchangers 101 and 102 switches the operation mode from the condenser to the evaporator, the high pressure valves 123 and 124 may be closed and the low pressure valves 127 and 128 may be opened. However, such abrupt valve switching may cause a problem of generating noise and deteriorating durability due to a large pressure difference between a high pressure refrigerant and a low pressure refrigerant.

Accordingly, the air conditioning apparatus 1 according to the implementation of the present disclosure may open the equilibrium pressure valves 135 and 136 for a certain time before the high pressure valves 123 and 124 are closed. Accordingly, the refrigerant flowing into the first refrigerant pipe 110 may gradually flow into the equilibrium pressure pipes 131 and 132.

The adjustment of the opening degree of the equilibrium pressure valves 135 and 136 may be performed slowly over time. Accordingly, the opening degree of the high pressure valves 123 and 124 and the low pressure valve 127 may also be controlled.

Pressure of the refrigerant pipes 110 and 115 may be lowered by the refrigerant introduced into the equilibrium pressure pipes 131 and 132.

Accordingly, the equilibrium pressure may be formed by reducing the pressure of the refrigerant pipes 110 and 115 within a certain range by opening the equilibrium pressure valves 135 and 136.

The equilibrium pressure valves 135 and 136 may be closed again. Therefore, the low pressure refrigerant passing through the heat exchangers 101 and 102 may flow to the low pressure guide pipes 125 and 126 without a large pressure difference.

Eventually, since an operation of the heat exchangers 101 and 102 is switched to the evaporator, noise generation and durability problems due to the pressure difference described above may be solved.

In some implementations, the air conditioning apparatus 1 may further include a controller. For example, the controller may include an electric circuit configured to control valves.

The controller may control a plurality of valves provided in the switching unit R and a plurality of valves 32, 49, 31*c*, 44*a*, 44*b*, 35*c*, 48*a*, and 48*b* provided in the refrigerant circulation flow path W such that the operation mode of the heat exchangers 101 and 102 according to the cooling or heating mode requested by the plurality of indoor units 51, 52, 53, and 54.

For example, the controller may control the operation of the high pressure valves 123 and 124, low pressure valves 127 and 128, the equilibrium pressure valves 135 and 136, and the flow valves 143 and 144 according to the operation mode of the heat exchangers 101 and 102.

In some examples, the operation in which the operation modes of the plurality of heat exchangers 101 and 102 are the same are all called "exclusive operation."

The exclusive operation may be understood as a case where the plurality of heat exchangers are operated only as evaporators or only as condensers. Here, the plurality of heat exchangers 101 and 102 are based on an operating (ON) heat exchanger, not an OFF heat exchanger.

An operation in which the operation modes of the plurality of heat exchangers 101 and 102 are different is called a "simultaneous operation."

The simultaneous operation may be understood as a case where some of the plurality of heat exchangers are operated as condensers and the others are operated as evaporators.

Hereinafter, a flow of the refrigerant will be briefly described in case where the first heat exchanger 101 and the second heat exchanger 102 are operated as evaporators. That is, the flow of the refrigerant when the heat exchangers 101 and 102 perform an evaporator exclusive operation.

Here, the water cooled while passing through the first heat exchanger 101 and the second heat exchanger 102 may circulate in the indoor units 51, 52, 53, and 54 operating in the cooling mode (ON).

The condensed refrigerant passing through the outdoor heat exchanger 15 of the outdoor unit 10 may be introduced into the switching unit R through the liquid line 27.

And the condensed refrigerant may be branched at the liquid line branch point 27*a* and flow to the first liquid guide pipe 141 and the second liquid guide pipe 142.

The condensed refrigerant flowing into the first liquid guide pipe 141 may be expanded while passing through the first flow valve 143. The expanded refrigerant may be evaporated by absorbing heat of water while passing through the first heat exchanger 101.

Similarly, the condensed refrigerant flowing into the second liquid guide pipe 142 may be expanded while passing through the second flow valve 144. The expanded refrigerant may be evaporated by absorbing heat of water while passing through the second heat exchanger 102.

The evaporated refrigerant discharged from the first heat exchanger 101 may be introduced into the first low pressure guide pipe 125 through the first refrigerant pipe 110 and flow to the low pressure gas pipe 25. Here, the first low pressure valve 127 is opened and the first high pressure valve 123 is closed.

Similarly, the evaporated refrigerant discharged from the second heat exchanger 102 may be introduced into the second low pressure guide pipe 126 through the second refrigerant pipe 115 and flow to the low pressure gas pipe 25. Here, the second low pressure valve 128 is opened and the second high pressure valve 124 is closed.

Hereinafter, any one of the first heat exchanger 101 and the second heat exchanger 102 is switched to a condenser to perform a simultaneous operation on the basis of the above-described evaporator exclusive operation will be described briefly.

For example, when the first heat exchanger 101 switches the operation mode to the condenser, the first high pressure valve 123 may be opened and the first low pressure valve 127 may be closed. Further, the first flow valve 143 may be fully opened.

The compressed refrigerant discharged from the compressor 11 and introduced into the high pressure gas pipe 20 may be introduced into the first refrigerant pipe 110 through the first high pressure guide pipe 121.

Further, the compressed refrigerant introduced into the first refrigerant pipe 110 may heat water while passing through the first heat exchanger 101. Here, the water absorbing the heat of the refrigerant may circulate to the indoor unit 50 that requires a heating operation.

The condensed refrigerant heat exchanged with water in the first heat exchanger 101 may flow to the liquid line branch point 27*a* through the first liquid guide pipe 141 because the first flow valve 143 is fully open. The condensed refrigerant may flow into the second liquid guide pipe 142 through the liquid line branch point 27*a* and join the condensed refrigerant introduced from the existing liquid line 27.

The joined condensed refrigerant may be expanded while passing through the second flow valve 144. As described above, the expanded refrigerant may be evaporated while passing through the second heat exchanger 102 and flow to the low pressure gas pipe 25 through the second low pressure guide pipe 126.

Accordingly, in a state where both the first heat exchanger 101 and the second heat exchanger 102 both are operated as evaporators, when the operation mode of the first heat exchanger 101 is switched, the first heat exchanger 101 may be operated as a condenser stably without having to reduce an operating frequency of the compressor or stop the compressor 11.

In some examples, when the heat exchangers 101 and 102 switches the operation mode, noise may occur due to a pressure difference of the refrigerants introduced into or discharged from the heat exchangers 101 and 102.

Therefore, the air conditioning apparatus 1 according to the implementation of the present disclosure may adjust the opening degree of the equilibrium pressure valves 135 and 136 to minimize the occurrence of noise.

For example, when the operation mode of the heat exchangers 101 and 102 is switched, the refrigerant flowing to the refrigerant pipes 110 and 115 through the high pressure pipes 121 and 124 may gradually flow into the equilibrium pressure pipes 131 and 132 as the equilibrium pressure valves 135 and 136 start to be opened. Accordingly, the pressure of the refrigerant pipes 110 and 115 may be gradually lowered.

Thereafter, when the pressure of the refrigerant pipe drops to a certain pressure to form an equilibrium pressure with the low pressure, the equilibrium pressure valves 135 and 136 and the high pressure valves 123 and 124 is closed, the low pressure valves 127 and 128 may be opened. The evaporated low pressure refrigerant may flow into the low pressure guide pipes 125 and 126.

Hereinafter, a method of matching (or connecting) the heat exchangers 101 and 102 and the indoor units 51, 52, 53, 54, 55, and 56 at an initial operation or a switching operation of the air conditioning apparatus 1 will be described in detail.

For convenience of explanation, the plurality of indoor units 50 may further include a fifth indoor unit 55 and a sixth indoor unit 56.

Here, the initial operation may be understood as an operation stage of the air conditioning apparatus 1 in which the heat exchangers 101 and 102 starts to be operated so that at least one of the plurality of indoor units 50 starts to be operated to provide cooling or heating to the room.

Also, the switching operation may be understood as an operation stage of the air conditioning apparatus 1 in which operation modes of the heat exchangers 101 and 102 are switched in case where the indoor unit 50 which is operated (ON) after the initial operation is changed in mode or is turned off or a case where the turned-off indoor unit 50 starts to be operated (ON) so as to be additionally connected to the heat exchangers 101 and 102.

In other words, the switching operation may be understood as a process in which the operation modes of the heat exchangers 101 and 102 are switched according to a change in the operated indoor unit after the initial operation.

Figure 3:
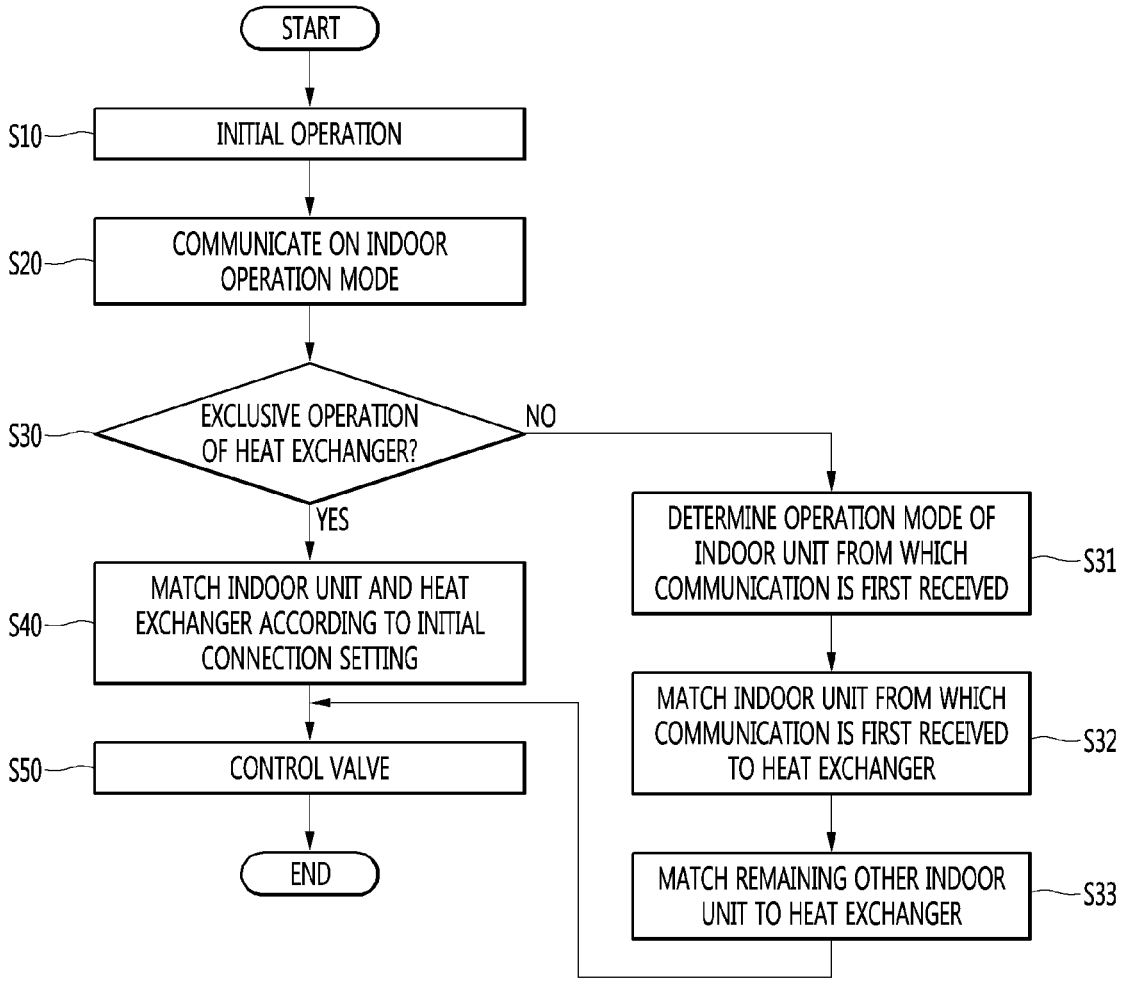
FIG. 3 is a flowchart showing an example control method for matching an indoor unit and a heat exchanger at the time of an initial operation of an air conditioning apparatus.
Figure 4:
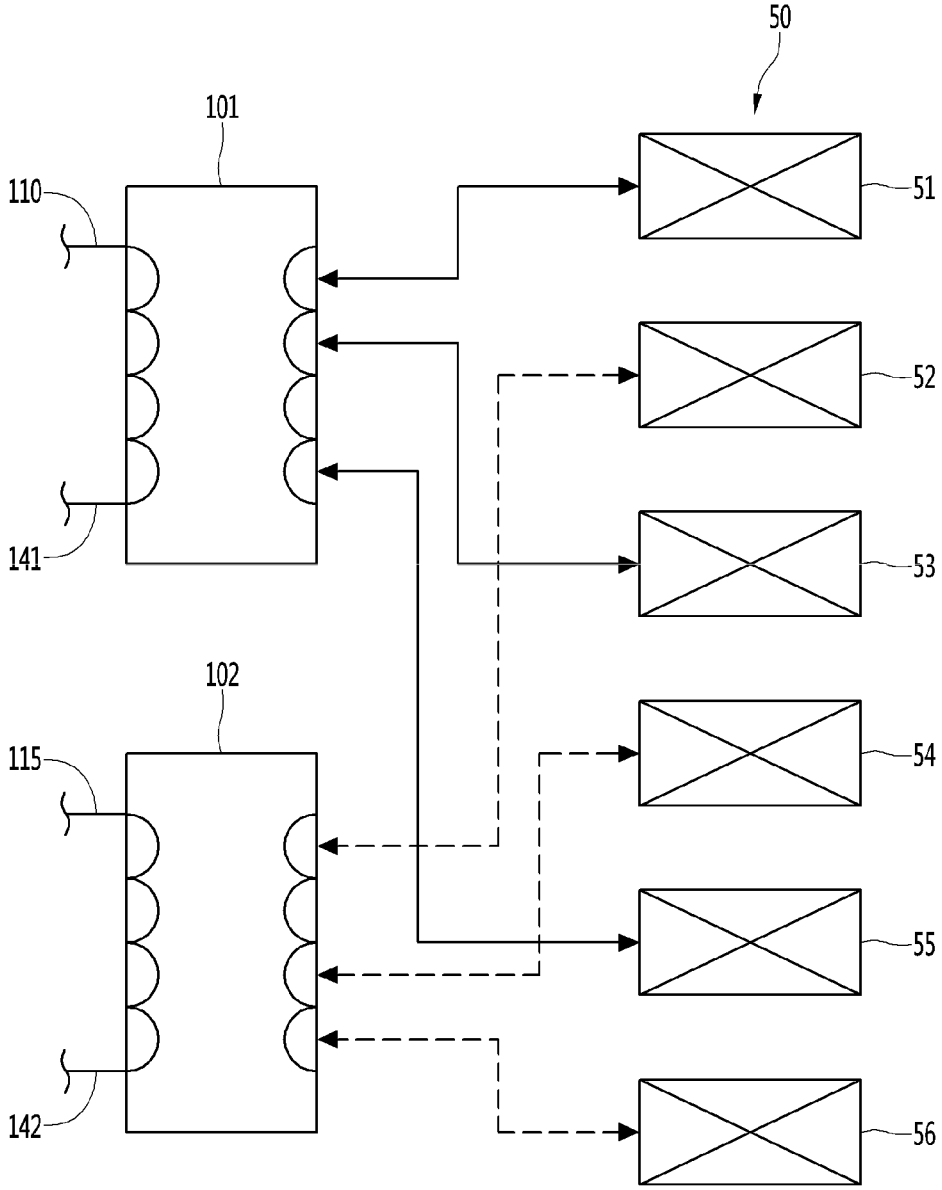
FIG. 4 is a schematic diagram illustrating an example of an initial connection setting of FIG. 3.
Figure 5:
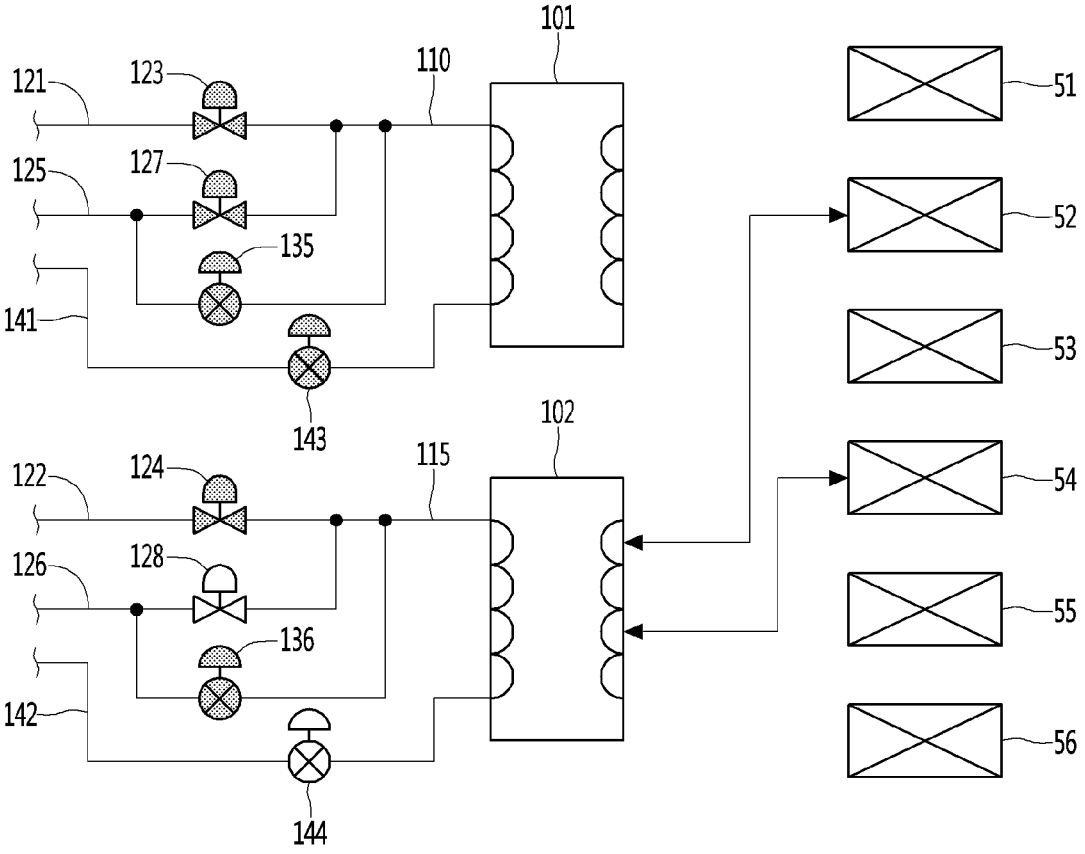
FIG. 5 is a schematic diagram showing an example of matching between an indoor unit and a heat exchanger in an exclusive operation at the time of an initial operation of an air conditioning apparatus.
Figure 6:
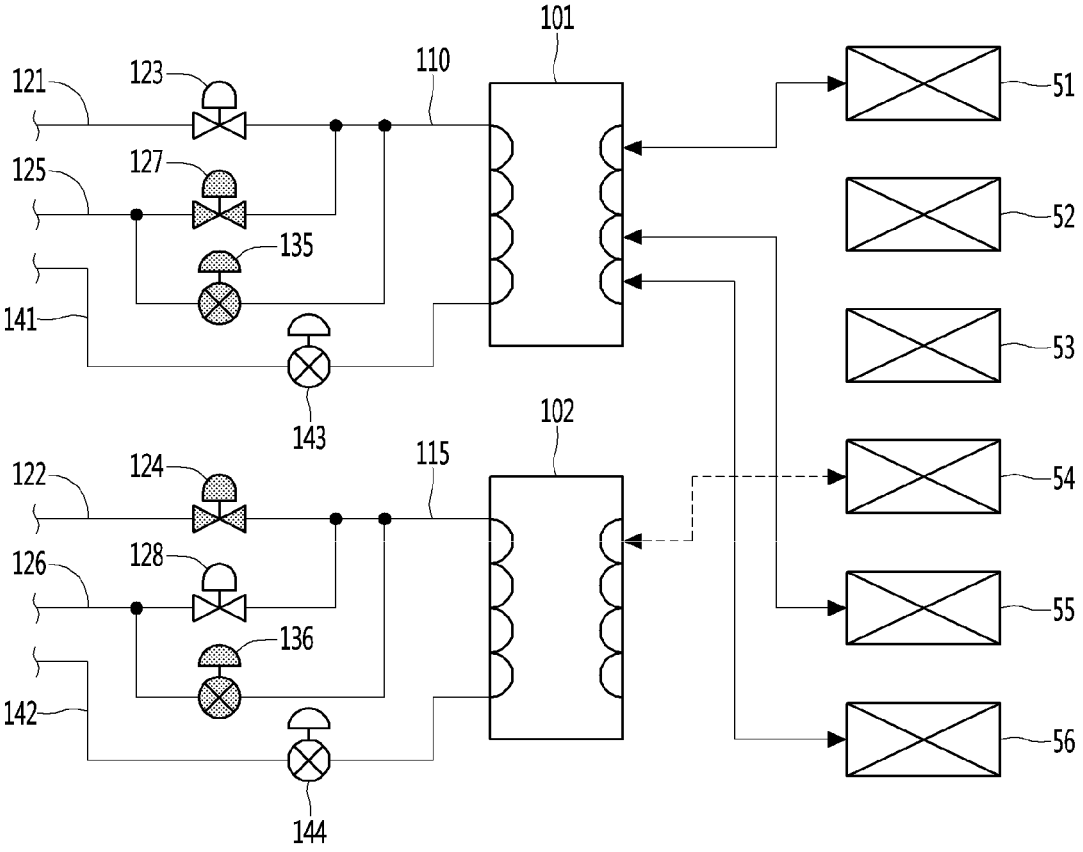
FIG. 6 is a schematic diagram showing an example of matching between an indoor unit and a heat exchanger in a simultaneous operation at the time of initial operation of an air conditioning apparatus.

FIG. 3 is a flowchart showing an example control method for matching an indoor unit and a heat exchanger at the time of an initial operation of an air conditioning apparatus, FIG. 4 is a schematic diagram illustrating an example of an initial connection setting of FIG. 3, FIG. 5 is a schematic diagram showing an example of matching between an indoor unit and a heat exchanger in an exclusive operation at the time of an initial operation of an air conditioning apparatus, and FIG. 6 is a schematic diagram showing an example of matching between an indoor unit and a heat exchanger in a simultaneous operation at the time of initial operation of an air conditioning apparatus.

For example, the method may include performing a matching operation to determine and set matching connections between one or more of the indoor units and the plurality of heat exchangers, for example, by controlling one or more of valves, pumps, sensors, etc. to define water flow paths between the one or more of the indoor units and the plurality of heat exchangers based on operation modes of the plurality of heat exchangers. In some cases, the matching connection may be determined based on operation modes of the indoor units or capacities of the indoor units.

Referring to FIGS. 3 to 6, the air conditioning apparatus 1 may perform the initial operation in which the indoor unit 50 starts to be operated (ON) and the heat exchangers 101 and 102 are first operated to provide cooling or heating to the room (S10).

That is, in the initial operation, at least one of the plurality of indoor units 51, 52, 53, 54, 55, and 56 may start operation.

As an example, an occupant may input a cooling or heating mode by operating (ON) at least one indoor unit of the plurality of indoor units 50.

Here, the input of the occupant may be performed by various input units. In some examples, the input unit may include a communication device such as a remote controller, a mobile phone, or the like.

The air conditioning apparatus 1 may perform communication with the indoor unit 50 when the initial operation starts. Further, the air conditioning apparatus 1 may determine an operation mode of the indoor unit 50 which starts to be operated (ON) (S20).

The controller may perform communication with the operated indoor unit 50 when at least one of the plurality of indoor units 50 starts to be operated (ON).

Hereinafter, the operated indoor unit 50 may be referred to as an "operated indoor unit."

For example, the controller may receive information such as a location of the operated indoor unit 50, an input operation mode, etc., upon receiving the input of the occupant.

As another example, the controller may receive environmental information of the corresponding room through a sensor provided in the operated indoor unit 50. The controller may determine an operation mode of the operated indoor unit to a cooling mode or a heating mode by comparing the environmental information received from the sensor with a user set temperature.

The air conditioning apparatus 1 may determine whether the heat exchangers 101 and 102 are exclusively operated based on the operation mode information transmitted through communication with the operated indoor unit 50 (S30).

That is, the controller may determine whether the plurality of heat exchangers 101 and 102 should perform an exclusive operation based on the operation mode of the operated indoor unit.

Specifically, the controller may determine operation modes of the heat exchangers 101 and 102 by collecting operation mode information of the indoor unit 50 starting to be operated among the plurality of indoor units 50.

For example, when the first indoor unit 51 and the second indoor unit 52 is operated (ON), the controller may communicate with the first indoor unit 51 and the second indoor unit 52 to receive an operation mode of the first indoor unit 51 and an operation mode information of the second indoor unit 52.

If the operation mode information received from the first indoor unit 51 and the operation mode information received from the second indoor unit 52 are the same, the controller may determine the exclusive operation defined as an operation in which the operation modes of the plurality of heat exchangers 101 and 102 are the same.

Here, the case where both the operation mode information are the same may be understood as a case where both the first indoor unit 51 and the second indoor unit 52 are operated in the heating mode or cooling mode.

As described above, the exclusive operation may be understood as an operation in which all of the operation modes of the plurality of heat exchangers 101 and 102 are operated as condensers or as evaporators.

In some cases, if the operation mode information received from the first indoor unit 51 and the operation mode information received from the second indoor unit 52 are different, the controller may determine the simultaneous operation as an operation in which the operation modes of the plurality of heat exchangers 101 and 102 are different.

Here, the case where the both operation mode information are different from each other may be understood as a case where the first indoor unit 51 is input to be operated in the heating mode and the second indoor unit 52 is input to be operated in the cooling mode, or vice versa.

As described above, the simultaneous operation may be understood as an operation in which part of the plurality of heat exchangers 101 and 102 is operated as condensers and the other is operated as an evaporator.

When the operation of the heat exchangers 101 and 102 is determined as the exclusive operation, the air conditioning apparatus 1 may match (or connect) the operated indoor unit 50 and the heat exchangers 101 and 102 according to a predetermined initial connection setting (S40).

The initial connection setting may be set such that capacities of the plurality of indoor units 50 are equally distributed to the plurality of heat exchangers 101 and 102.

In some examples, the air conditioning apparatus 1 may include a total of N indoor units 50. The N indoor units 50 may have different capacities. Here, N may be defined as a certain natural number.

The initial connection setting may be defined as information that matches (or connects) the N indoor units 50 and the plurality of heat exchangers 101 and 102. For example, the initial connection setting may be stored in advance in a memory provided in the air conditioning apparatus 1.

That is, the initial connection setting may be understood as information of previously matching the total indoor units 50 and the heat exchangers 101 and 102 provided in the air conditioning apparatus 1 irrespective of the operated indoor unit (ON).

Specifically, the initial connection setting may arrange the N indoor units 50 in order of capacity. For example, in the initial connection setting, the capacities of the N indoor units 50 may be arranged in ascending order. Here, the N indoor units 50 may be defined as operated indoor units that start operation (ON).

As described above, the plurality of indoor units 50 may be installed with various capacities according to the conditions of each room. If the indoor units and the heat exchangers are connected without considering the capacities of the indoor units, a problem may occur in which a load is concentrated on any one heat exchanger.

Therefore, in the initial connection setting, first, the total N indoor units 50 provided in the air conditioning apparatus 1 may be aligned in ascending order in consideration of the capacities thereof.

The initial connection setting may be set such that the aligned indoor units 50 may be set to be matched (or connected) to the plurality of heat exchangers 101 and 102 in order.

For example, referring to FIG. 4, according to the initial connection setting, the first indoor unit 51 having the lowest capacity among the aligned indoor units 50 may be matched to the first heat exchanger 101, the second indoor unit 52 having a second lowest capacity may be matched to the second heat exchanger 102, the third indoor unit 53 having a third low capacity may be matched to the first heat exchanger 101, and the fourth indoor unit 53 having a fourth low capacity may be matched to the second heat exchanger 102, the fifth indoor unit 54 having a fifth low capacity may be matched to the first heat exchanger 101, and the sixth indoor unit 56 having a sixth low capacity may be matched to the second heat exchanger 102.

That is, the initial connection setting may alternately (or in a crossing manner) match the N indoor units 50 arranged in ascending order to the first heat exchanger 101 and the second heat exchanger 102.

Accordingly, even if all the indoor units 50 are operated, deviations of the load applied to each of the heat exchangers 101 and 102 is minimized.

When the exclusive operation of the heat exchangers 101 and 102 is determined in step S30, the controller may match the operated indoor units and the heat exchangers 101 and 102 according to the initial connection setting.

That is, the operated indoor units may be matched to the heat exchangers 101 and 102 specified in the initial connection setting.

For example, referring to FIG. 5, when the second indoor unit 52 and the fourth indoor unit 54 are operated indoor units 52 and 54 operated in the cooling mode, the controller may match the second indoor unit 52 and the fourth indoor unit 54 to the second heat exchanger 102 according to the initial connection setting.

Here, the operation of the first heat exchanger 101 may maintain an OFF state.

Further, the air conditioning apparatus 1 may perform valve control so that the refrigerant and water may circulate according to the result of matching the heat exchangers 101 and 102 and the operated indoor units (S50).

That is, the air conditioning apparatus 1 may perform valve control so that the refrigerant and the water circulate according to the operation modes of the heat exchangers 101 and 102 determined corresponding to the operation of the indoor units 50.

For example, referring to FIG. 5, after the exclusive operation is determined as the cooling mode, if both the operated indoor units 52 and 54 are matched to the second heat exchanger 102, the controller may control the plurality of valves such that the second heat exchanger 102 operates as an evaporator and cooled water circulates in the second indoor unit 52 and the fourth indoor unit 54.

Specifically, the controller may control to close the first high pressure valve 123, the first low pressure valve 127, the first equilibrium pressure valve 135, the first flow valve 143, the second high pressure valve 124, and the second equilibrium pressure valve 136. Accordingly, the refrigerant may evaporate while passing through the second heat exchanger 102.

The controller may turn off the first pump 42 and operates the second pump 46 so that water may be heat exchanged with the refrigerant in the second heat exchanger 102.

The controller may close the first on/off valve 32 so that water cooled through the second heat exchanger 102 circulates in the second indoor unit 52 and the fourth indoor unit 54 and control operations of the second on/off valve 36 and the flow path guide valve 49 connected to the second indoor unit 52 and the fourth indoor unit 54.

In some examples, if the simultaneous operation of the heat exchanger, not the exclusive operation, is determined in step S30, the air conditioning apparatus 1 may determine an operation mode of the indoor unit 50 from which communication is first received (S31).

Specifically, the controller may determine the simultaneous operation determined as an operation in which the operation modes of the plurality of heat exchangers 101 and 102 are different (non-identical) through communication with the operated indoor unit.

The controller may first determine the operation mode of the indoor unit 50 from which communication is first received.

Referring to FIG. 6, when the operation mode of the first indoor unit 51 is first received in step S20, the controller may store the operation mode of the first indoor unit 51 in a memory.

For example, the first indoor unit 51 may be input to be operated in the heating mode. When the simultaneous operation is determined, the controller may determine an operation mode, i.e., the heating mode, received from the first indoor unit 51.

The air conditioning apparatus 1 may match the indoor unit 50 from which communication is first received and the heat exchangers 101 and 102 (S32).

Specifically, the controller may first match the first indoor unit 51 starting operation in the heating mode to the heat exchangers 101 and 102 according to the initial connection setting.

In some examples, the controller may match the indoor unit 51 from which communication is first received to the first heat exchanger 101 according to the initial connection settings. Thus, the first heat exchanger 101 may be operated as a condenser.

That is, when the simultaneous operation is determined, if the operation mode of the first heat exchanger 101 is determined as a condenser, the operation mode of the second heat exchanger 102 may be determined as an evaporator.

Alternatively, if the indoor unit 51 from which communication is first received is determined to be the cooling mode, the first heat exchanger 101 may operate as an evaporator, and accordingly, the second heat exchanger 102 may be operated as a condenser.

After the matching between the indoor unit from which communication is first received and the heat exchangers 101 and 102 is completed, the air conditioning apparatus 1 may match the remaining operated indoor unit 50 and the heat exchangers 101 and 102 (S33).

Specifically, the controller may match the operated indoor unit 50 from which communication is first received and the heat exchangers 101 and 102, and then match the remaining operated indoor unit 50 and the heat exchangers 101 and 103 according to the matching result.

Referring to FIG. 6, since the operation mode of the first heat exchanger 101 is determined to be a condenser, the controller may match the other remaining operated indoor unit 50 to the first heat exchanger 101 or the second heat exchanger 102 according to the operation mode of the remaining operated indoor unit 50.

That is, in step S33, matching between the indoor unit 50 and the heat exchangers 101 and 102 that does not follow the initial connection setting may occur.

In more detail, the controller may determine the operation modes of the fourth indoor unit 54, the fifth indoor unit 55 and the sixth indoor unit 56, which are the remaining operated indoor unit 50, in step S20. Here, the fourth indoor unit 54 may start to be operated in the cooling mode and the fifth indoor unit 55 and the sixth indoor unit 56 may start to be operated in the heating mode.

Therefore, the controller may match the fifth indoor unit 55 and the sixth indoor unit to the first heat exchanger 101 whose operation mode was determined in the previous step. The controller may match the fourth indoor unit 54 to the second heat exchanger 102.

If the matching between all the operated indoor units 50 and the heat exchangers 101 and 102 is completed in the above-described step, the air conditioning apparatus 1 may perform valve control according to the completed matching result (S50).

In some examples, the controller may open the first high pressure valve 123 and the first flow valve 143 so that the first heat exchanger 101 is operated as a condenser and open the second low pressure valve 128 and the second flow valve 144 so that the second heat exchanger 102 may be operated as an evaporator.

Further, the controller may control operations of the first on/off valve 32, the second on/off valve 26 and the flow path guide valve 49 so that high temperature water circulates in the first indoor unit 51, the fifth indoor unit 55, and the sixth indoor unit 56 and low temperature water circulates in the fourth indoor unit 54. Further, the controller may operate (ON) the first pump 42 and the second pump 46.

Figure 7:
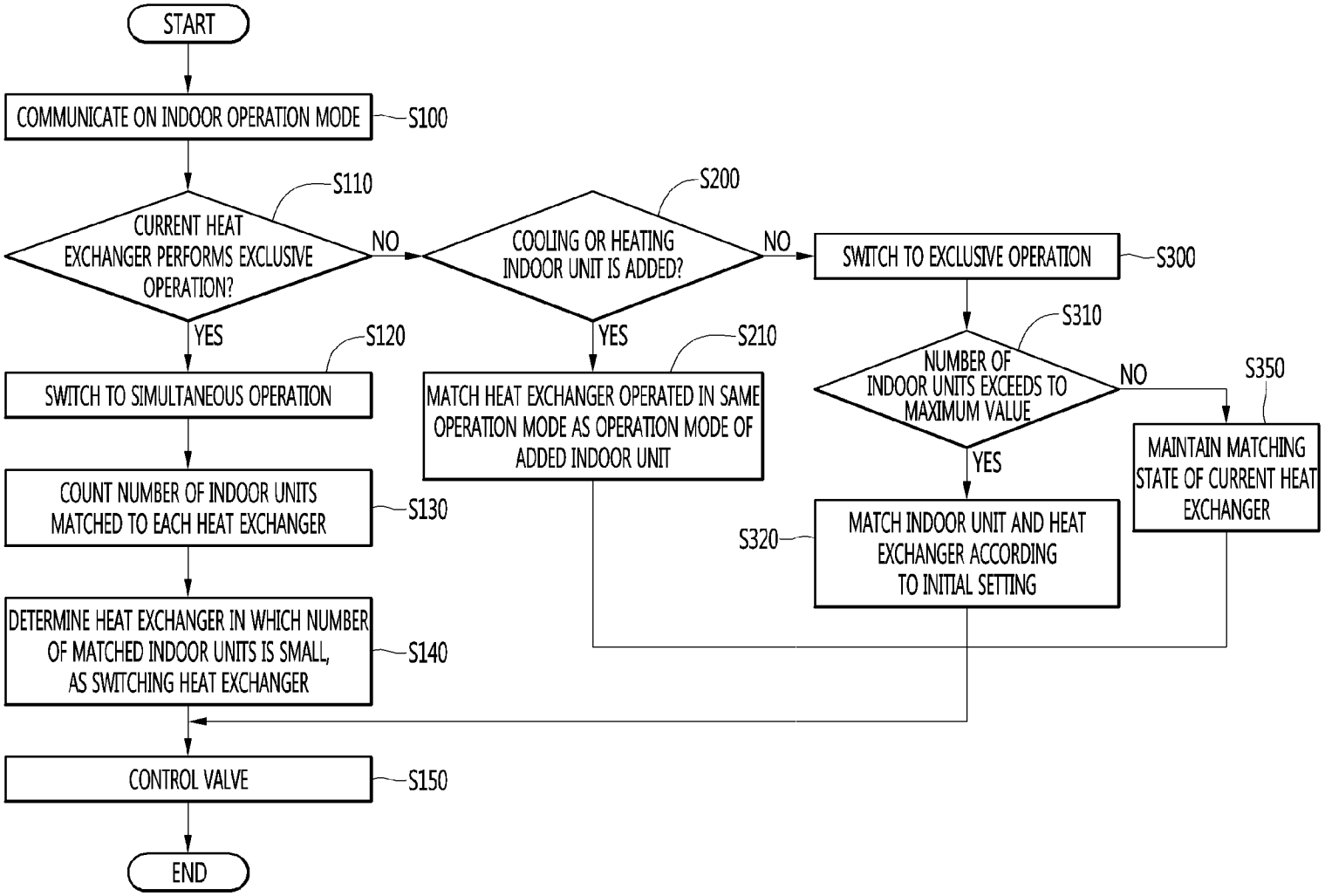
FIG. 7 is a flowchart showing an example control method for matching an indoor unit and a heat exchanger at the time of a switching operation of an air conditioning apparatus.
Figure 8A:
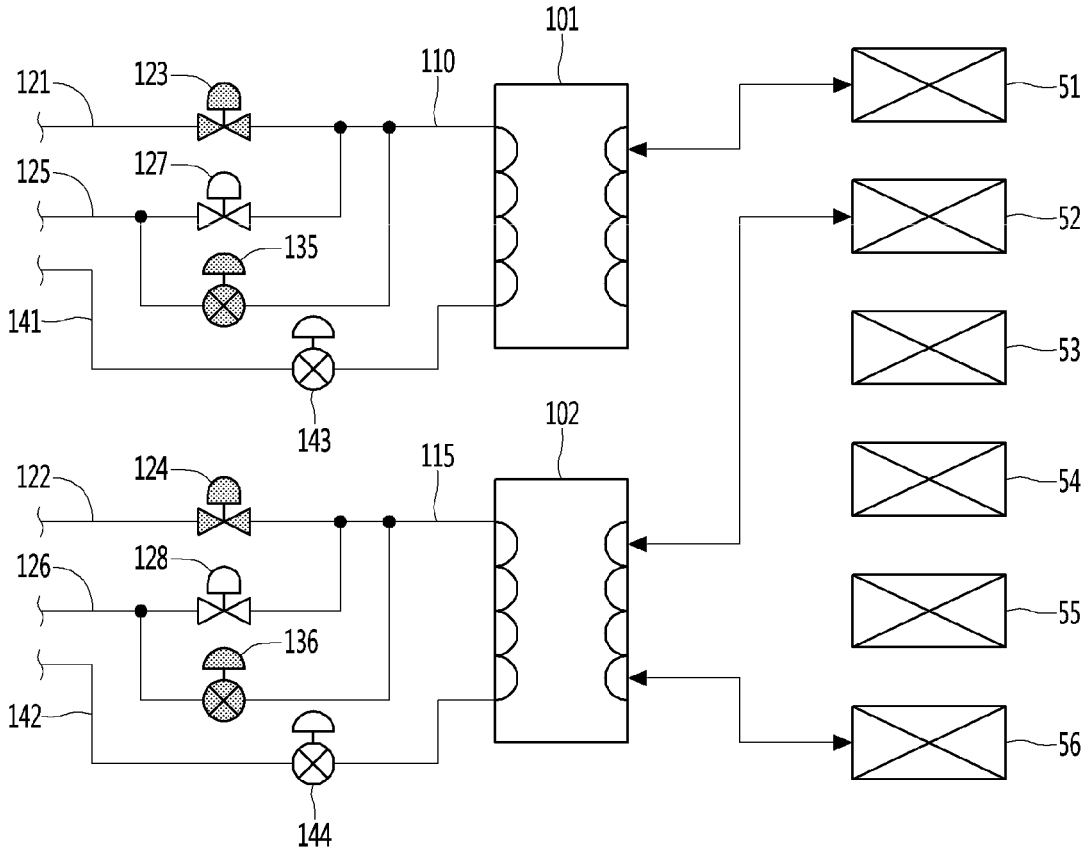
FIGS. 8A and 8B are schematic diagrams showing examples of matching between an indoor unit and a heat exchanger at the time of a switching operation from an exclusive operation to a simultaneous operation.
Figure 8B:
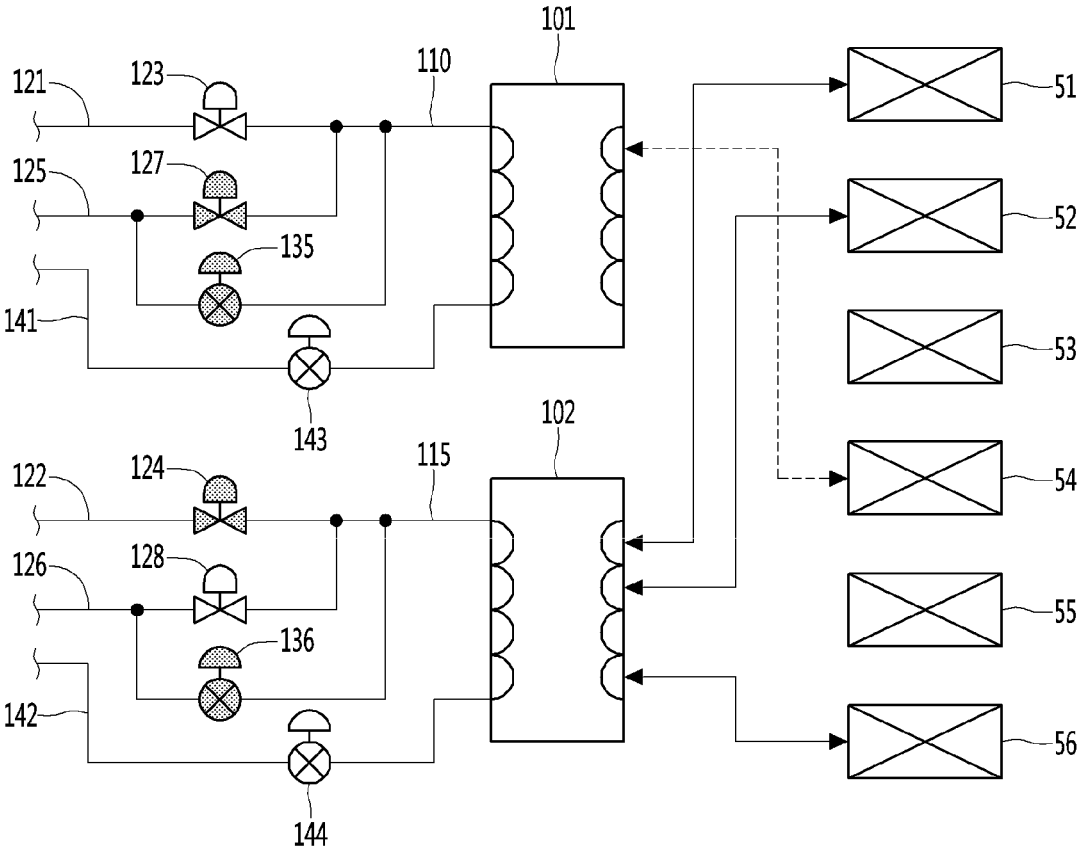

FIG. 7 is a flowchart showing an example control method for matching an indoor unit and a heat exchanger at the time of a switching operation of an air conditioning apparatus, and FIGS. 8A and 8B are schematic diagrams showing examples of matching between an indoor unit and a heat exchanger at the time of a switching operation from an exclusive operation to a simultaneous operation.

In more detail, FIG. 8A is a view showing an exclusive operation in which the first heat exchanger 101 and the second heat exchanger 102 are operated as evaporators and FIG. 8B shows a simultaneous operation in which the first heat exchanger is switched to a condenser in the exclusive operation of FIG. 8A.

Referring to FIGS. 7 to 8B, the air conditioning apparatus 1 may perform a switching operation in which the operation modes of the heat exchangers 101 and 102 are switched in case where the indoor unit 50 operated (ON) is changed in mode or is turned off and a case where an unoperated (OFF) indoor unit 50 starts to be operated (ON) and additionally connected to the heat exchangers 101 and 102.

In order to perform the switching operation, the air conditioning apparatus 1 may perform communication with the indoor unit 50 (S100).

Specifically, the controller may determine whether there is an indoor unit changed in operation mode from cooling to heating or from heating to cooling, among the operated indoor units, through communication with the indoor unit 50.

Further, the controller, through communication, may determine whether there is an indoor unit which starts to be operated, among unoperated (OFF) indoor units. In this case, the controller may be provided with operation mode information of the indoor unit which newly starts to be operated.

Further, the controller may determine whether there is an indoor unit which is turned off (OFF), among the operated indoor units, through communication.

In other words, the controller may determine whether the switching operation is required upon receiving the information of the indoor unit 50 described above.

Referring to FIG. 8B, as an example, the fourth indoor unit 54 as an unoperated (OFF) indoor unit may start operation in the heating mode. The controller may receive operation mode information of the fourth indoor unit 54 and use the received operation mode information as basic information for matching the fourth indoor unit 54 and the heat exchangers 101 and 102.

The air conditioning apparatus 1 may determine whether to perform the exclusive operation of the current heat exchangers 101 and 102 (S110).

Also, the air conditioning apparatus 1 may determine whether a switching operation is required.

That is, the air conditioning apparatus 1 may detect current operation modes of the heat exchangers 101 and 102 for the switching operation. For example, the controller may determine whether the first heat exchanger 101 and the second heat exchanger 102 operate in the same operation mode.

In some implementations, the controller may detect the operation mode of each of the heat exchangers 101 and 102 to determine whether the heat exchangers 101 and 102 are currently operated in the same operation mode.

Specifically, in step S110, the controller may determine whether the heat exchangers 101 and 102 currently perform an exclusive operation as evaporators or an exclusive operation as condensers.

The controller may determine whether the switching operation is required in the current operational state of the heat exchangers 101 and 102 in step S110. Here, the switching operation may be understood as a control for changing the operation of the heat exchangers 101 and 102 from the exclusive operation to the simultaneous operation or from the simultaneous operation to the exclusive operation.

That is, in step S110, the controller may determine whether the switching operation is necessary based on the driving mode information received in step S100.

If the switching operation is not necessary, for example, when an indoor unit is added to start the operation in the cooling mode during the exclusive operation as the evaporator, the controller may determine that the switching operation is not necessary.

If switching operation is necessary, the controller may determine whether to switch to the simultaneous operation or the exclusive operation.

In this regard, the following steps will be described in detail.

For example, referring to FIG. 8B, in step S100, the controller may receive information input so that the fourth indoor unit 54, which is an unoperated indoor unit, is operated (ON) in the heating mode. Also, if it is determined that the heat exchangers 101 and 102 currently perform the exclusive operation as evaporators, the controller may switch an operation mode of any one of the heat exchangers 101 and 102 so as to be matched to the fourth indoor unit 54.

As another example, in case where an unoperated indoor unit is input to be operated in the cooling mode, if the heat exchangers 101 and 102 currently perform the exclusive operation as condensers, the controller may switch an operation mode of any one of the current heat exchangers 101 and 102.

That is, when the current heat exchangers 101 and 102 performs the exclusive operation, the air conditioning apparatus 1 may start the switching operation to the simultaneous operation (S120).

Specifically, the controller may determine whether the exclusive operation of the current heat exchangers 101 and 102 should be switched to the simultaneous operation, based on the operation mode information of the operated indoor unit determined in step S100.

In some examples, in case where the exclusive operation is performed by the evaporator, if at least one operated indoor unit is to be operated in the heating mode, the controller may start the switching operation to the simultaneous operation.

Further, in case where the exclusive operation is performed by the condenser, if at least one operated indoor unit is to be operated in the cooling mode, the controller may start the switching operation to the simultaneous operation.

And when the switching operation is started to the simultaneous operation, the air conditioning apparatus 1 may calculate the number of indoor units matched to each of the heat exchangers 101 and 102 (S130).

Specifically, the controller may count the number of indoor units matched to the first heat exchanger 101 and the number of indoor units matched to the second heat exchanger 102.

As an example, referring to FIG. 8A, the controller may count the first indoor units 51 matched to the first heat exchanger 101 and being operated. The controller may also count the second indoor unit 52 and the sixth indoor unit 56 matched to the second heat exchanger 102 and being operated.

The air conditioning apparatus 1 may determine the heat exchangers 101 and 102 having a small number of matched indoor units as the switching heat exchangers to switch the operation mode for the simultaneous operation.

Specifically, the controller may determine the heat exchangers 101 and 102 in which the counted number of the indoor units is small as the switching heat exchanger, on the basis of the number of indoor units counted for each of the heat exchangers 101 and 102.

Referring to FIG. 8A as an example, since the number of indoor units matched to the first heat exchanger 101 is smaller than that of the second heat exchanger 102, the first heat exchanger 101 may be determined as the switching heat exchanger.

That is, when the heat exchangers 101 and 102 are changed from the exclusive operation to the simultaneous operation, the air conditioning apparatus 1 selects a case where a change in cycle in which the refrigerant and water circulate is small and performs switching of the heat exchangers 101 and 102, without specifying an operation mode of each of the heat exchangers 101 and 102 in advance.

Accordingly, an unnecessary valve operation is minimized, whereby it is possible to improve heat exchange efficiency between the refrigerant and water and to minimize power consumption, as compared with the related art.

If the counted numbers of indoor units for each of the heat exchangers 101 and 102 are equal, the controller may determine a certain heat exchanger 101 or 102 or a switching heat exchanger according to the initial connection setting because the indoor units 50 are relatively equally distributed to the heat exchangers 101 and 102.

The air conditioning apparatus 1 may perform valve control (S150).

Here, the valve control may be understood as valve control for switching the operation mode of the heat exchangers 101 and 102 determined as a switching heat exchanger.

Referring to FIGS. 8A and 8B, for example, the controller may open the first high pressure valve 123 and close the first low pressure valve 127 in order to switch the operation mode of the first heat exchanger 101 determined as the switching heat exchanger to the condenser. In this case, the controller may reduce a refrigerant pressure difference between the first high pressure valve 123 and the first low pressure valve 127 by adjusting the opening degree of the first equilibrium pressure valve 135.

Figure 9A:
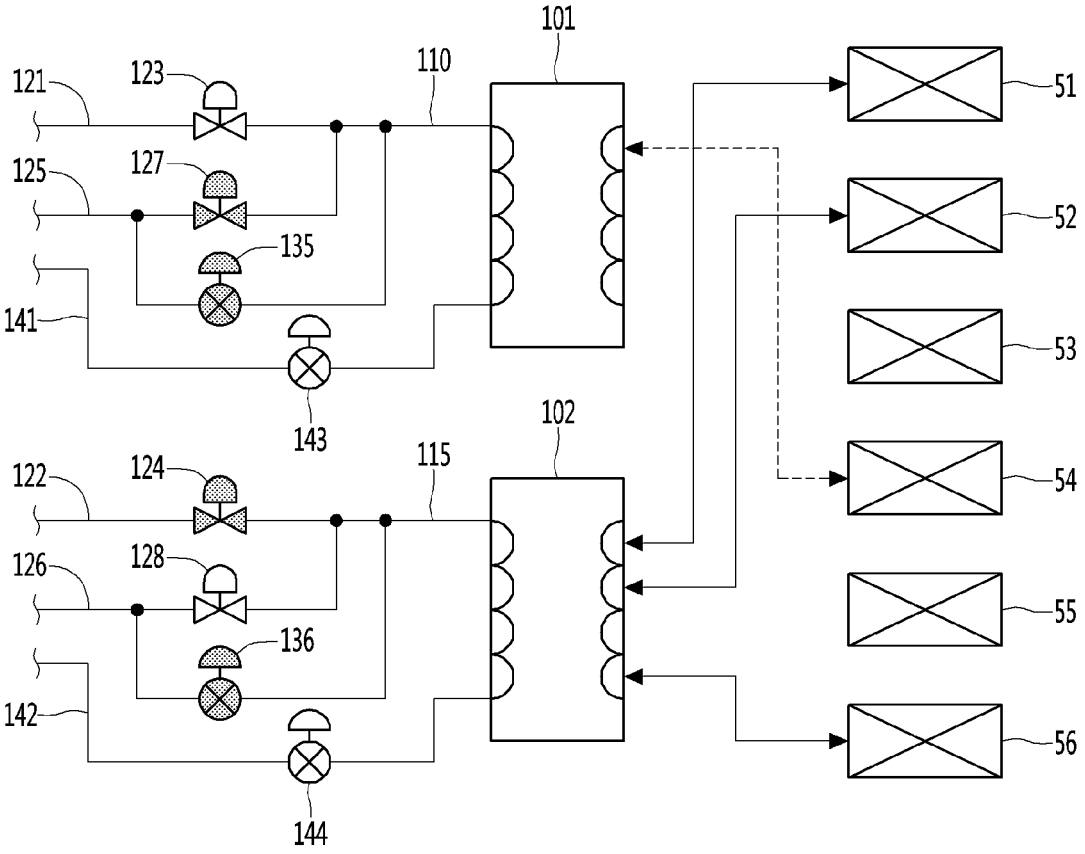
FIGS. 9A and 9B are schematic diagrams showing examples of matching between an indoor unit and a heat exchanger when an indoor unit operating in a cooling or heating mode is added during a simultaneous operation.
Figure 9B:
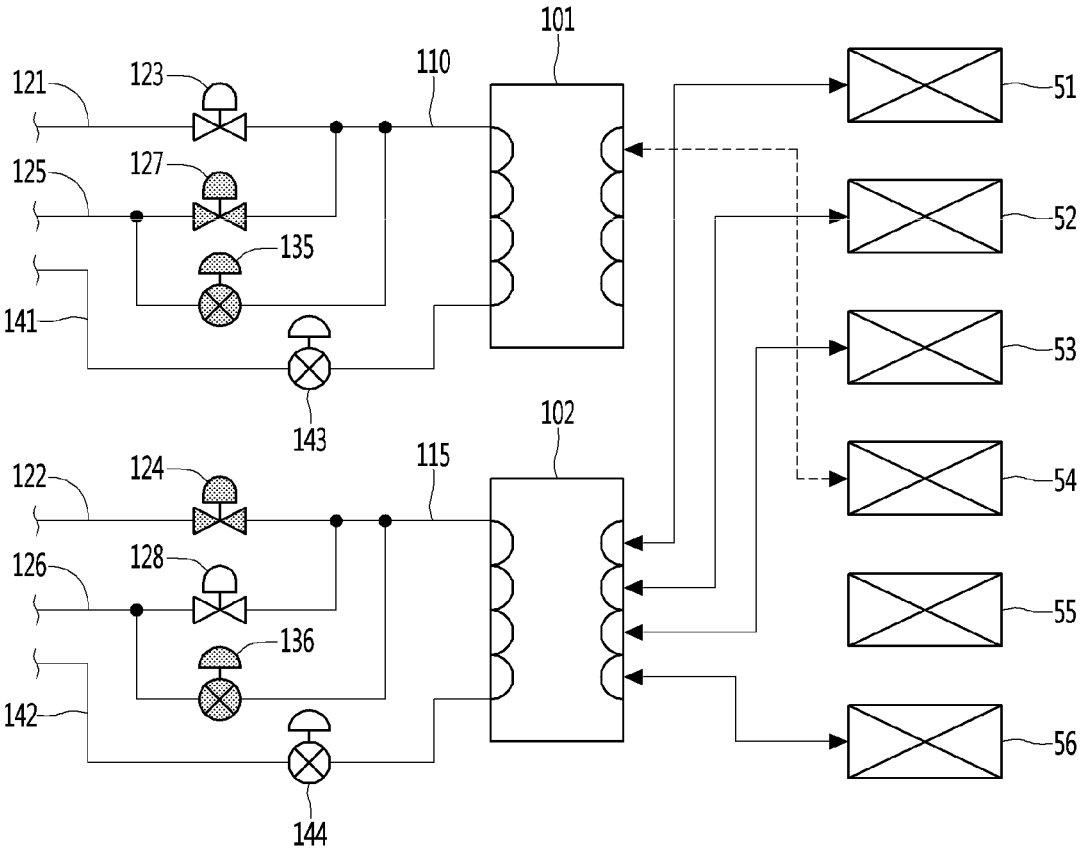

FIGS. 9A and 9B are schematic diagrams showing examples of matching between an indoor unit and a heat exchanger when an indoor unit operating in a cooling or heating mode is added during a simultaneous operation.

Specifically, FIG. 9A shows an example of matching between the heat exchangers 101 and 102 and the indoor unit 50 to perform a simultaneous operation and FIG. 9B shows an example of matching between the heat exchangers 101 and 102 and the indoor unit 50 when the indoor unit 53 operated in the cooling mode is added.

Referring to FIGS. 7, 9A, and 9B, when the current heat exchangers 101 and 102 do not perform the exclusive operation in step S110, the air conditioning apparatus 1 may determine whether to add the operated indoor unit 50 (S200).

That is, the controller may determine that the current heat exchangers 101 and 102 perform the simultaneous operation in step S110. Also, the controller may determine the indoor unit 50 that provides cooling or heating to the room additionally.

For example, referring to FIGS. 9A and 9B, the third indoor unit 53, among unoperated (OFF) indoor units, may start operation in the cooling mode. In this case, the controller may determine that the third indoor unit 53 is operated in the cooling mode through communication in step S100 described above.

When the current heat exchangers 101 and 102 perform the simultaneous operation, the controller may add a third indoor unit 53 starting operation in the cooling mode to the operated indoor unit.

The air conditioning apparatus 1 may match the heat exchangers 101 and 102 operated in the same operation mode as the operation mode of the indoor unit 53 added to the operated indoor unit to the added indoor unit 53 (S210).

Here, the same operation mode means the heat exchanger 102 operated as an evaporator to which the indoor unit operated in the cooling mode is matched when the added indoor unit 53 is in the cooling mode, and means the heat exchanger 101 operated as a condenser to which the indoor unit operated in the heating mode is matched when the added indoor unit is in the heating mode.

For example, referring to FIGS. 9A and 9B, when the third indoor unit 53 added to the operated indoor unit is input to be operated in the cooling mode, the controller may match the second heat exchanger 102 operated as the evaporator to the third indoor unit 53.

In some implementations, where the heat exchangers 101 and 102 are connected to the added indoor unit while maintaining the current operation, it may be more advantageous than the case where the heat exchangers 101 and 102 and the indoor unit 50 are matched according to the initial connection setting described above. That is, cycle efficiency may be improved, while minimizing power consumption by preventing an unnecessary switching operation.

The air conditioning apparatus 1 may perform valve control (S150).

Here, the valve control may be performed such that water circulates to the heat exchanger 102 matched to the added indoor unit 53.

In some examples, the controller may control the second on/off valve 36*c* and the third flow path guide valve 49*c* connected to the third indoor unit 53, so that water circulates in the third indoor unit 53 and the second heat exchanger 102.

Figure 10A:
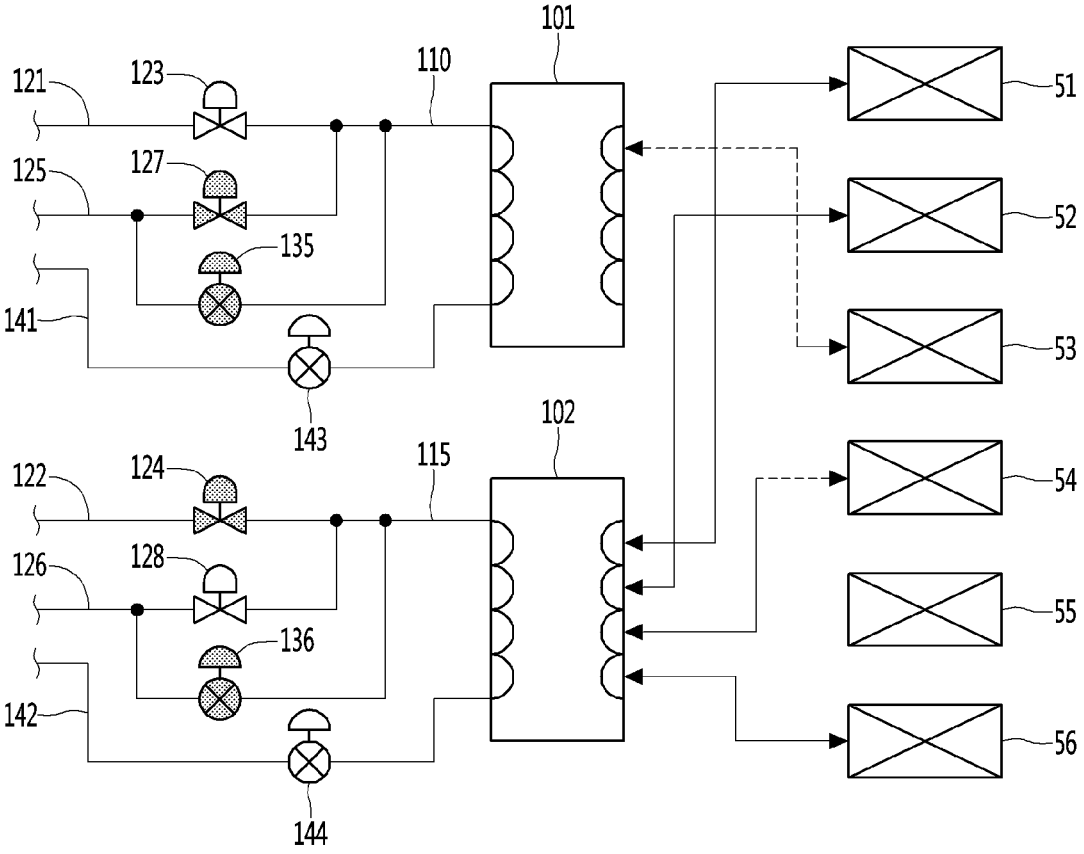
FIGS. 10A and 10B are schematic views showing examples of matching between an indoor unit and a heat exchanger at the time of switching operation from a simultaneous operation to an exclusive operation.
Figure 10B:
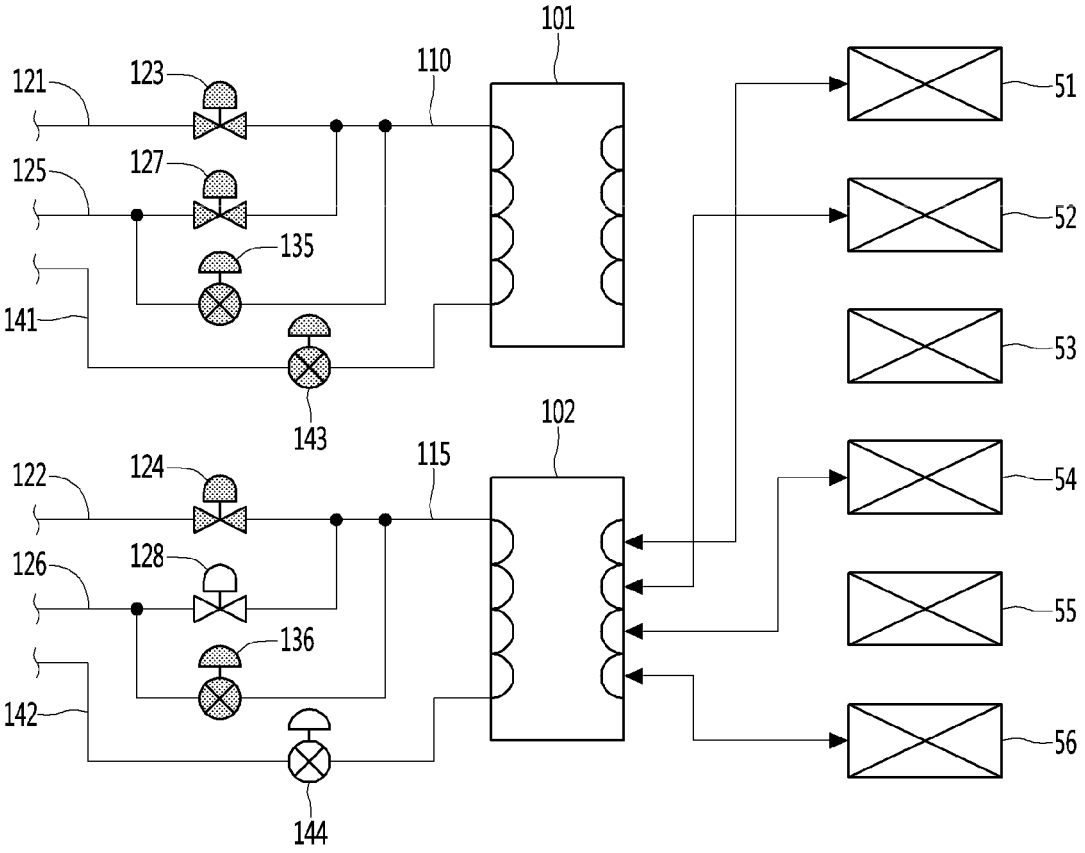

FIGS. 10A and 10B are schematic views showing examples of matching between an indoor unit and a heat exchanger at the time of switching operation from a simultaneous operation to an exclusive operation.

Specifically, FIG. 10A shows an example of matching between the heat exchangers 101 and 102 and the indoor unit 50 to perform a simultaneous operation and FIG. 10B shows an example of matching between the heat exchangers 101 and 102 and the indoor unit 50 when the operated indoor unit 53 is turned off.

Referring to FIGS. 7, 10A, and 10B, when it is determined that the operated indoor unit 50 is not added in step S200, the air conditioning apparatus 1 may perform a switching operation as an exclusive operation (S300).

Specifically, if the heat exchangers 101 and 102 are simultaneously operated and the operated indoor unit 50 is not added, the controller may determine a case where at least one of the operated indoor units 50 is turned off or a case where the operation mode is changed.

For example, referring to FIGS. 10A and 10B, the operated indoor unit 50, that is, the third indoor unit 53 operated in the heating mode, may be turned off.

That is, the controller may receive information indicating that any one of the operated indoor units is turned off (OFF) or the operation mode is changed, through communication with the indoor unit 50.

Thus, the controller may control the heat exchangers 101 and 102 which currently perform the simultaneous operation to perform an exclusive operation.

In some examples, the exclusive operation may include an operation in which modes of the heat exchangers 101 and 102 in operation are the same. For example, when only the second heat exchanger 102, among the first heat exchanger 101 and the second heat exchanger 102, is operated, the heat exchangers 101 and 102 may be understood to perform the exclusive operation.

When the heat exchangers 101 and 102 are switched from the simultaneous operation to the exclusive operation, the air conditioning apparatus 1 may determine whether the number of the indoor units 50 matched to the heat exchangers 101 and 102 exceeds a predetermined maximum value Max (S310).

For example, referring to FIG. 10A, when the third indoor unit 53 matched to the first heat exchanger 101 and performing heating is changed in operation mode to cooling, the controller may determine whether the number of the operated indoor units matched to the second heat exchanger 102 exceeds the predetermined maximum value Max.

When the number of the operated indoor units 50 matched to the heat exchangers 101 and 102 exceeds the predetermined maximum value, the air conditioning apparatus 1 may match the indoor units 50 and the heat exchangers 101 and 102 according to the initial connection setting as described above (S320).

For example, when the number of the operated indoor units matched to the second heat exchanger 102 operating as evaporators exceeds the predetermined maximum value, the third indoor unit 53 changed in the operation mode from heating to cooling may be matched to the first heat exchanger 101 according to the initial connection setting.

The controller may switch the operation mode of the first heat exchanger 101 to the evaporator and perform valve control so that water heat exchanged with the refrigerant circulates in the matched third indoor unit 53 (S150).

Thus, the controller may control the first heat exchanger 101 to be switched in the operation mode from the condenser to the evaporator. Accordingly, a phenomenon that a load is concentrated on any one of the plurality of heat exchangers 101 and 102 to degrade cycle efficiency may be prevented.

In some examples, if the number of the operated indoor units 50 matched to the heat exchangers 101 and 102 does not exceed the preset maximum value, the air conditioning apparatus 1 may maintain the current matching state of the heat exchangers 101 and 102 and the operated indoor units (S350).

For example, referring to FIGS. 10A and 10B, the third indoor unit 53 matched to the first heat exchanger 101 and performing a heating operation may be turned off. In this case, the controller may maintain the matching state of the operated indoor units 51, 52, 54, and 56 matched to the second heat exchanger 102 operating as the evaporator.

That is, the controller may allow the first heat exchanger 101 to wait, in consideration of an indoor environment of the third indoor unit 53 which is turned off at the most recent time and seasonal factors.

For example, if the third indoor unit 53 is first operated in the heating mode due to environmental factors such as seasons and a room temperature, the room in which the third indoor unit 53 is installed is highly likely to be restarted to provide heating again.

In some cases, when at least any one of the operated indoor units 51, 52, 54, and 56 matched to the second heat exchanger 102 is matched to the first heat exchanger 101 according to the initial connection setting after the third indoor unit 53 is turned off, in case where the third indoor unit 53 is restarted in the heating mode, a plurality of valves may have to be switched again. That is, power consumption of the air conditioning apparatus 1 may be increased.

Further, in the above case, since the first heat exchanger 101 is switched to be operated again as a condenser, a load and heat loss may increase due to a temperature change of water and refrigerant. As a result, heating performance of the third indoor unit 53 may be deteriorated.

Thus, the controller may block a flow of the refrigerant to the first heat exchanger 101 and give a pause to wait for a certain time.

That is, the air conditioning apparatus 1 may block circulation of water to the third indoor unit 53 and perform valve control to block the flow of the refrigerant to the first heat exchanger 101 (S150).

Accordingly, since performance of the cycle is maintained even if the third indoor unit 53 is operated again in the heating mode, the third indoor unit 53 may rapidly provide heating to the room where the third indoor unit 53 is installed, and unnecessary power consumption and heat loss may be prevented.

It will be apparent to those skilled in the art that various modifications and variations may be made in the present disclosure without departing from the spirit or scope of the disclosures. Thus, it is intended that the present disclosure covers the modifications and variations of this disclosure provided they come within the scope of the appended claims and their equivalents.

What is claimed is:

1. An air conditioning apparatus comprising:
- an outdoor unit configured to circulate refrigerant, the outdoor unit comprising a high pressure gas pipe, a low pressure gas pipe, and a liquid line;
- a plurality of indoor units configured to circulate water;
- a plurality of heat exchangers, each of the plurality of heat exchangers being configured to perform heat exchange between the outdoor unit and the plurality of indoor units;
- a high pressure guide pipe that connects the high pressure gas pipe to a first side of each of the plurality of heat exchangers;
- a low pressure guide pipe that extends from the low pressure gas pipe to the high pressure guide pipe;
- a liquid guide pipe that extends from the liquid line to a second side of each of the plurality of heat exchangers; and
- a controller configured to:
  - based on communication with the plurality of indoor units, determine an operation mode of each of the plurality of heat exchangers, the operation mode of each of the plurality of heat exchangers being one of an evaporator mode or a condenser mode at a given time,
  - based on the operation mode, determine matching connections between the plurality of indoor units and the plurality of heat exchangers, and
  - circulate the water through an indoor unit among the plurality of indoor units according to the matching connections.

2. The air conditioning apparatus of claim 1, wherein the controller is configured to determine the matching connections to balance loads applied to the plurality of heat exchangers at an initial operation of any one of the plurality of indoor units.

3. The air conditioning apparatus of claim 2, wherein the controller is configured to determine the matching connections based on capacities of the plurality of indoor units at the initial operation.

4. The air conditioning apparatus of claim 1, wherein the controller is configured to:

at an initial operation of any one of the plurality of indoor units, determine an operation order of the plurality of indoor units based on capacities of the plurality of indoor units; and according to the operation order, sequentially set the matching connections between the plurality of indoor units and the plurality of heat exchangers.

5. The air conditioning apparatus of claim 4, wherein all of the plurality of heat exchangers have one equal size.

6. The air conditioning apparatus of claim 2, wherein the controller is configured to:

after the initial operation, perform a switchover operation in which the operation mode of one of the plurality of heat exchangers is changed based on a change event of operating indoor units that are connected to the one of the plurality of heat exchangers; and in the switchover operation, count a number of the operating indoor units among the plurality of indoor units.

7. The air conditioning apparatus of claim 6, wherein the change event of the operating indoor units comprises:

turning off one or more of the operating indoor units, or turning on, among the plurality of indoor units, an indoor unit that was in an OFF state.

8. The air conditioning apparatus of claim 6, wherein the controller is configured to switch the operation mode based on the number of the operating indoor units being less than a reference number.

9. The air conditioning apparatus of claim 1, wherein the controller is configured to select the operation mode among the evaporator mode and the condenser mode according to an operation mode of one or more operating indoor units connected to the plurality of heat exchangers.

10. The air conditioning apparatus of claim 1, further comprising:

an outflow pipe that extends from at least one of the plurality of heat exchangers to an entrance of at least one of the plurality of indoor units, the outflow pipe being configured to circulate the water;

an inflow pipe that extends from an exit of the at least one of the plurality of indoor units to the at least one of the plurality of heat exchangers;

a pump installed at the inflow pipe and configured to apply pressure to the water in a direction to the at least one of the plurality of heat exchangers;

an on/off valve installed at the outflow pipe and configured to control flow of water into each of the plurality of indoor units; and a flow path guide valve installed at the inflow pipe and configured to control flow of water discharged from each of the plurality of indoor units.

11. The air conditioning apparatus of claim 10, wherein the controller is configured to set a flow direction of the water based on opening and closing each of the on/off valve and the flow path guide valve.

12. The air conditioning apparatus of claim 1, further comprising:

a high pressure valve installed at the high pressure guide pipe;

a low pressure valve installed at the low pressure guide pipe; and a flow valve installed at the liquid guide pipe.

13. The air conditioning apparatus of claim 12, wherein the controller is configured to set a flow direction of the refrigerant based on opening and closing each of the high pressure valve, the low pressure valve, and the flow valve.

14. The air conditioning apparatus of claim 1, further comprising an equilibrium pressure pipe branched from the low pressure guide pipe and connected to the first side of one of the plurality of heat exchangers.

15. The air conditioning apparatus of claim 14, further comprising:

a high pressure valve installed at the high pressure guide pipe;

a low pressure valve installed at the low pressure guide pipe; and an equilibrium pressure valve installed at the equilibrium pressure pipe.

16. The air conditioning apparatus of claim 15, wherein the high pressure guide pipe and the low pressure guide pipe are connected to a first refrigerant pipe, the first refrigerant pipe extending from a branch point located between the high pressure valve and the low pressure valve and being connected to the first side of the one of the plurality of heat exchangers, and wherein the equilibrium pressure pipe is branched from the low pressure guide pipe before the low pressure valve and connected to the first refrigerant pipe after the branch point.

17. The air conditioning apparatus of claim 1, wherein the high pressure guide pipe and the low pressure guide pipe are connected to one refrigerant pipe that is directly connected to the first side of one of the plurality of heat exchangers.

18. The air conditioning apparatus of claim 17, wherein the liquid guide pipe is branched from the liquid line and directly connected to the second side of the one of the plurality of heat exchangers.

* * * * *